US006518519B1

(12) United States Patent
Crane, III et al.

(10) Patent No.: US 6,518,519 B1
(45) Date of Patent: Feb. 11, 2003

(54) METHOD AND APPARATUS FOR DETERMINING A WEIGHT OF A PAYLOAD

(75) Inventors: Carl D. Crane, III, Gainesville, FL (US); Joseph Duffy, Gainesville, FL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/651,173

(22) Filed: Aug. 30, 2000

(51) Int. Cl.[7] ..... G01G 19/08; G01G 19/10; G01G 19/14; G06F 19/00

(52) U.S. Cl. ..... 177/136; 177/136; 177/141; 702/174; 701/50

(58) Field of Search ..... 177/136, 139, 177/141; 702/174; 701/50

(56) References Cited

U.S. PATENT DOCUMENTS

| | | | | |
|---|---|---|---|---|
| 2,635,868 A | | 4/1953 | Reid | 177/145 |
| 2,742,162 A | | 4/1956 | Mandt | 414/21 |
| 3,061,117 A | | 10/1962 | Kruse | 376/451 |
| 4,230,196 A | | 10/1980 | Snead | 177/141 |
| 4,499,960 A | | 2/1985 | Ehrich et al. | 177/141 |
| 4,627,013 A | | 12/1986 | Ichiyama et al. | 702/174 |
| 4,635,739 A | | 1/1987 | Foley et al. | 177/145 |
| 4,677,579 A | | 6/1987 | Radomilovich | 702/174 |
| 4,691,792 A | * | 9/1987 | Shintani | 177/141 |
| 4,744,239 A | | 5/1988 | Kyrtsos et al. | 73/11 |
| 4,792,004 A | | 12/1988 | Sheffield | 177/141 |
| 4,835,719 A | | 5/1989 | Sorrells | 702/174 |
| 4,845,975 A | | 7/1989 | Kyrtsos et al. | 73/11 |
| 4,852,674 A | | 8/1989 | Gudat | 177/141 |
| 4,866,419 A | | 9/1989 | Kyrtsos et al. | 340/443 |
| 4,887,454 A | | 12/1989 | Kyrtsos et al. | 73/11 |
| 4,919,222 A | | 4/1990 | Kyrtsos et al. | 177/139 |
| 4,995,468 A | | 2/1991 | Fukuda | 177/139 |
| 5,067,572 A | | 11/1991 | Kyrtsos et al. | 177/139 |
| 5,070,953 A | | 12/1991 | Kyrtsos et al. | 177/25.14 |
| 5,082,071 A | | 1/1992 | Kyrtsos et al. | 177/25.14 |
| 5,105,895 A | | 4/1992 | Kyrtsos | 177/25.14 |
| 5,105,896 A | | 4/1992 | Kyrtsos | 177/139 |
| 5,161,628 A | * | 11/1992 | Wirth | 177/137 |
| 5,167,287 A | | 12/1992 | Pomies | 177/1 |
| 5,178,226 A | | 1/1993 | Bowman et al. | 177/139 |
| 5,182,712 A | | 1/1993 | Kyrtsos et al. | 701/50 |
| 5,461,803 A | * | 10/1995 | Roke | 701/50 |
| 5,509,293 A | | 4/1996 | Karumanchi | 177/139 |
| 5,557,526 A | | 9/1996 | Anderson | 701/50 |
| 5,714,719 A | * | 2/1998 | Otsuka et al. | 177/141 |
| 5,824,965 A | * | 10/1998 | Fujii et al. | 177/136 |
| 5,959,257 A | * | 9/1999 | Campbell et al. | 177/136 |

FOREIGN PATENT DOCUMENTS

SU 1254308 A2 8/1986

OTHER PUBLICATIONS

Fu et al. "Robotics: Control, Sensing, Vision, and Intelligence" McGraw–Hill, Inc. pp. 12–22, Copyright 1987.*

* cited by examiner

*Primary Examiner*—Randy W. Gibson
(74) *Attorney, Agent, or Firm*—Clifton G Green; Kelsey L Milman

(57) ABSTRACT

Methods and apparatuses for determining a mass of a payload in a work machine. The work machine has a chassis, a cab coupled with the chassis, and a boom coupled with the cab. A first actuator is coupled with the boom and the cab and moves the boom relative to the cab. The work machine has a stick coupled with the boom, and a second actuator coupled with the stick and the boom that moves the stick relative to the boom. The work machine also has a bucket operable to receive the payload. The bucket is coupled with the stick, and a third actuator is coupled with the bucket and the stick and moves the bucket relative to the stick. A first joint angle of the boom relative to the cab is determined at at least two instances in time. A second joint angle of the stick relative to the boom is determined at at least two instances in time. A third joint angle of the bucket relative to the stick is determined at at least two instances in time. A first actuator force exerted on the first actuator is determined at at least two instances in time. A second actuator force exerted on the second actuator is determined at at least two instances in time. A third actuator force exerted on the third actuator is determined at at least two instances in time. A plurality of physical characteristics of the work machine is determined. The mass of the bucket and payload is determined as a function of the first joint angles, the second joint angles, the third joint angles, the first actuator forces, the second actuator forces, the third actuator forces, and the plurality of predetermined physical characteristics.

54 Claims, 6 Drawing Sheets

Fig. 4

Table 1: Mechanism Parameters for Model 325 Excavator
(Note: All inertia terms with reference to center of mass point.)

| Name | Description | Units | Value |
|---|---|---|---|
| $a_{12}$ | dist. between O and $R_2$ | m | 6.15 |
| $a_{23}$ | dist. between $R_2$ and $R_3$ | m | 3.2 |
| $x_A$ | x coordinate of point A | m | 0.767 |
| $y_A$ | y coordinate of point A | m | -0.669 |
| $x_O$ | x coordinate of point O | m | 0.165 |
| $y_O$ | y coordinate of point O | m | 0 |
| $x_N$ | x coordinate of point N | m | -1.93 |
| $y_N$ | y coordinate of point N | m | -0.393 |
| $s_B$ | s coordinate of point B | m | 2.505 |
| $t_B$ | t coordinate of point B | m | 1.1 |
| $s_D$ | s coordinate of point D | m | 3.518 |
| $t_D$ | t coordinate of point D | m | 1.217 |
| $s_J$ | s coordinate of point J | m | 3.343 |
| $t_J$ | t coordinate of point J | m | 0.7 |
| $u_E$ | u coordinate of point E | m | -0.8325 |
| $v_E$ | v coordinate of point E | m | 0.343 |
| $u_F$ | u coordinate of point F | m | 0.485 |
| $v_F$ | v coordinate of point F | m | 0.708 |
| $u_G$ | u coordinate of point G | m | 2.72 |
| $v_G$ | v coordinate of point G | m | 0.035 |
| $u_K$ | u coordinate of point K | m | 0.861 |
| $v_K$ | v coordinate of point K | m | 0.322 |
| $p_I$ | p coordinate of point I | m | 0 |
| $q_I$ | q coordinate of point I | m | 0.485 |
| $L_{GH}$ | dist. between G and H | m | 0.685 |
| $L_{HI}$ | dist. between H and I | m | 0.64 |
| $C_m$ | mass of cab | kg | 11230 |
| $I_{cxx}$ | cab link inertia | kg-m$^2$ | 8000 |
| $I_{cyy}$ | cab link inertia | kg-m$^2$ | 22000 |
| $I_{czz}$ | cab link inertia | kg-m$^2$ | 14000 |
| $I_{cxy}$ | cab link inertia | kg-m$^2$ | 0 |
| $I_{cxz}$ | cab link inertia | kg-m$^2$ | 0 |
| $I_{cyz}$ | cab link inertia | kg-m$^2$ | 0 |
| $B_m$ | mass of boom | kg | 2040 |
| $I_{bss}$ | boom link inertia | kg-m$^2$ | 476 |
| $I_{btt}$ | boom link inertia | kg-m$^2$ | 8876 |
| $I_{bzz}$ | boom link inertia | kg-m$^2$ | 9208 |
| $I_{bst}$ | boom link inertia | kg-m$^2$ | 418 |
| $I_{bsz}$ | boom link inertia | kg-m$^2$ | 0 |
| $I_{btz}$ | boom link inertia | kg-m$^2$ | 0 |
| $S_m$ | mass of stick | kg | 946 |
| $I_{suu}$ | stick link inertia | kg-m$^2$ | 113 |
| $I_{svv}$ | stick link inertia | kg-m$^2$ | 995 |
| $I_{szz}$ | stick link inertia | kg-m$^2$ | 1085 |
| $I_{suv}$ | stick link inertia | kg-m$^2$ | 132 |
| $I_{suz}$ | stick link inertia | kg-m$^2$ | 0 |
| $I_{svz}$ | stick link inertia | kg-m$^2$ | 0 |

METHOD AND APPARATUS FOR DETERMINING A WEIGHT OF A PAYLOAD

TECHNICAL FIELD

This invention relates generally to determining the weight of a load in a bucket of work machine, and more particularly, to determining the weight of a load in a bucket of a work machine having multiple degrees of freedom.

BACKGROUND

A variety of conventional ways exist to measure the weight of a payload in a bucket of a work machine. Due to the complexity of the process, however, many of these ways contain inherent limitations. For example, some ways are limited to work machines having only 2 degrees of freedom of the bucket, e.g., a front loader. This technique would not be usable on machines having more degrees of freedom, e.g., an excavator. Other ways require the work machine to perform the measurement only while the payload is motionless, or in a given position. This is problematic in that it requires the operator to operate the machine in a way that may add time to each digging cycle. Still other ways require calibration of the measuring system using a known load, or approximate the weight of the payload based on the performance of a different (baseline) machine having a similar configuration, e.g., curve fitting. The former can add unwanted time to the operation of the machine that could otherwise be spent digging, while the latter assumes there is little or no deviation between the work machine and the baseline machine, which is often untrue.

SUMMARY OF THE INVENTION

The present invention provides methods and apparatuses for determining a mass of a payload in a work machine. The work machine has a chassis, a cab coupled with the chassis, and a boom coupled with the cab. A first actuator is coupled with the boom and the cab and moves the boom relative to the cab. The work machine has a stick coupled with the boom, and a second actuator coupled with the stick and the boom that moves the stick relative to the boom. The work machine also has a bucket operable to receive the payload. The bucket is coupled with the stick, and a third actuator is coupled with the bucket and the stick and moves the bucket relative to the stick. A first joint angle of the boom relative to the cab is determined at at least two instances in time. A second joint angle of the stick relative to the boom is determined at at least two instances in time. A third joint angle of the bucket relative to the stick is determined at at least two instances in time. A first actuator force exerted on the first actuator is determined at at least two instances in time. A second actuator force exerted on the second actuator is determined at at least two instances in time. A third actuator force exerted on the third actuator is determined at at least two instances in time. A plurality of physical characteristics of the work machine is determined. The mass of the bucket and payload is determined as a function of the first joint angles, the second joint angles, the third joint angles, the first actuator forces, the second actuator forces, the third actuator forces, and the plurality of predetermined physical characteristics.

BRIEF DESCRIPTION OF THE DRAWINGS

FIG. 4 shows a table listing the constant mechanism parameters for a Caterpillar model 325 excavator according to one embodiment of the invention.

DETAILED DESCRIPTION

Figure 1:
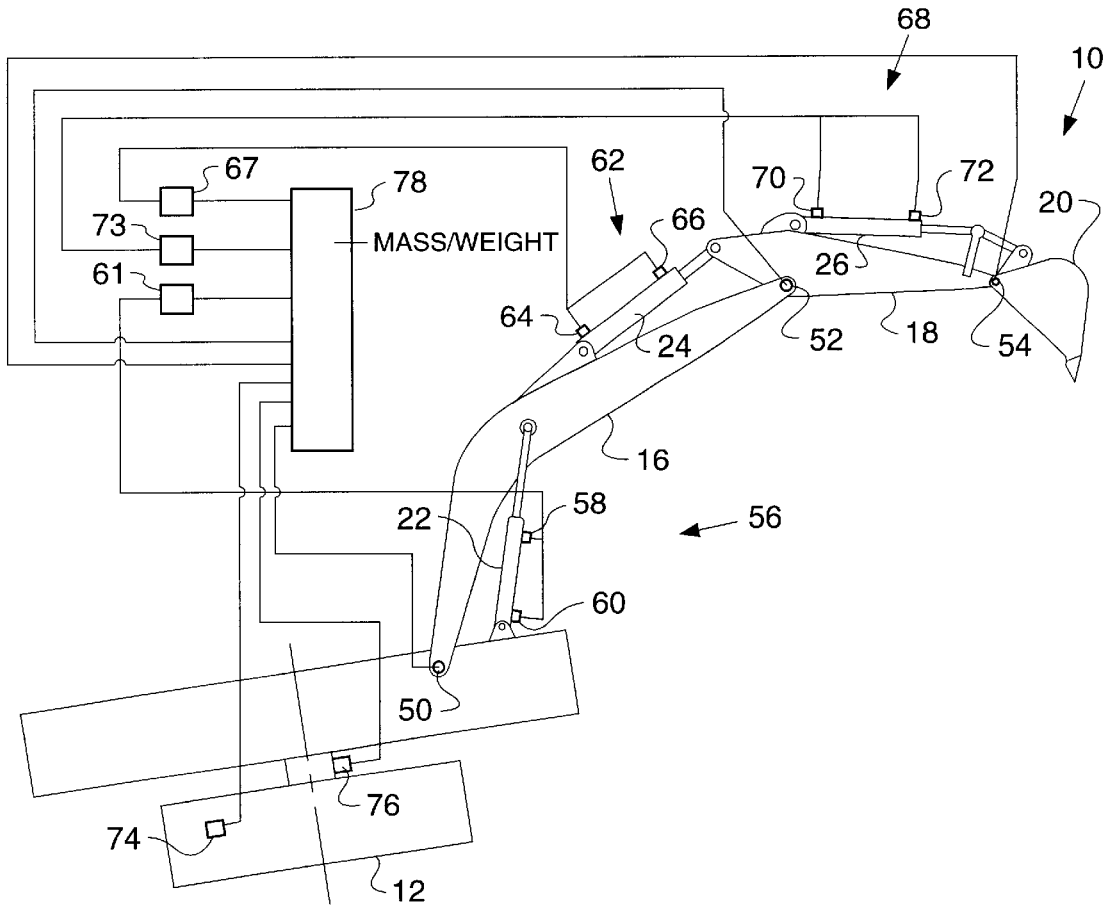
FIG. 1 is a symbolic side view of a work machine according to one embodiment of the invention.

FIG. 1 is a symbolic side view of a work machine, such as an excavator 10, according to one embodiment of the invention. Other appropriate work machines known to those skilled in the art may also be used, such as backhoe loaders or front shovels, for example. The excavator 10 includes a chassis 12 that rests on the ground and a cab 14 coupled with, and typically, although not necessarily, moveable relative to the chassis 12. A first linkage arm, such as a boom 16, is coupled with and moveable relative to the cab 14. A second linkage arm, such as a stick 18 is coupled with and moveable relative to the boom 16. A payload-containing device, such as a bucket 20, is coupled with and moveable relative to the stick 18. The bucket 20 receives a payload (not shown), whose mass or weight can be determined according to one embodiment of the invention.

PART I: KINEMATIC ANALYSIS

A. Problem Statement

Figure 2:
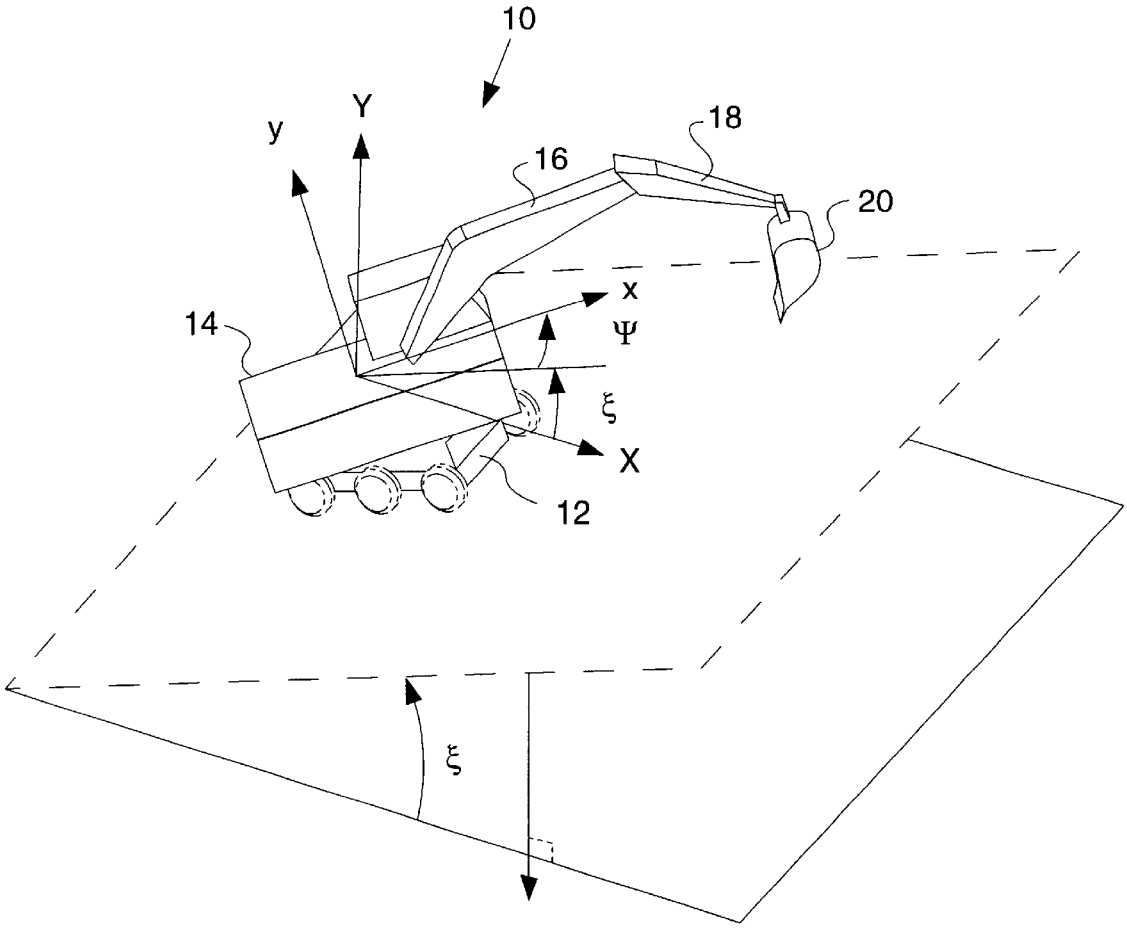
FIG. 2 shows a fixed reference coordinate system and an additional coordinate system that has been attached to the cab according to one embodiment of the invention.

FIG. 2 shows a fixed reference coordinate system (XY) and an additional coordinate system (xy) that has been attached to the cab according to one embodiment of the invention. The origin of the cab coordinate system is located on the first axis of rotation at a position so that its x axis also intersects the second axis of rotation. The origin of the fixed coordinate system is located coincident with the origin of the xy system with the Y axis vertical (parallel to the direction of gravity) and the X axis horizontal and pointing in the "steepest uphill direction".

Figure 3:
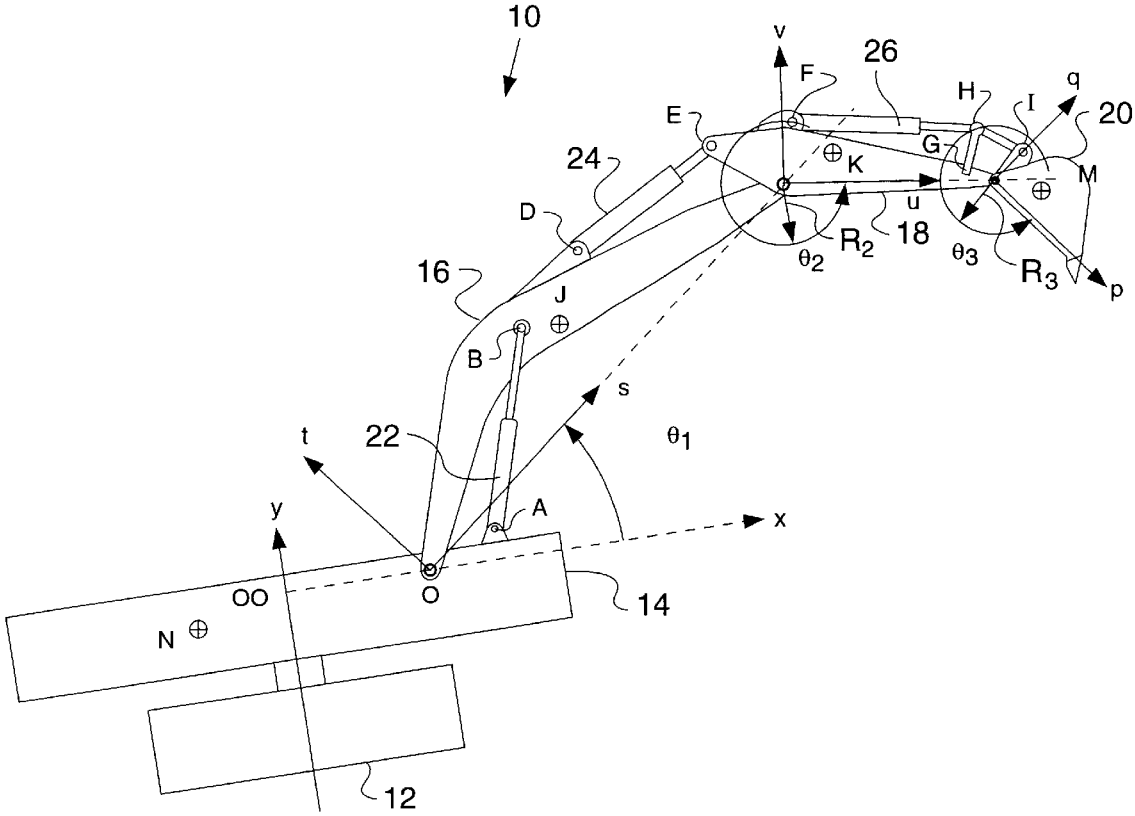
FIG. 3 shows the xy coordinate system that is attached to the cab, and additional coordinate systems that are attached to the boom, stick, and bucket, according to one embodiment of the invention.

FIG. 3 shows the xy coordinate system that is attached to the cab 14, and additional coordinate systems that are attached to the boom 16 (st), stick 18 (uv), and bucket 20 (pq) according to one embodiment of the invention. The excavator 10 has been modeled so that the centerlines of the boom 16, stick 18, and bucket 20 as well as three linear hydraulic cylinders 22, 24, 26 which actuate these links lie in the xy plane. FIG. 4 (Table 1) lists the constant mechanism parameters for a Caterpillar model 325 excavator according to one embodiment of the invention. The parameters for work machines having different characteristics may be determined by ways known to those skilled in the art.

The problem statement may now be stated as follows: given:

constant mechanism parameters (See FIG. 4)

inclination angle, $\xi$ (See FIG. 2)

joint angle parameters $\psi$, $\theta_1$, $\theta_2$, $\theta_3$ (see FIGS. 2 and 3) as well as their first and second time derivatives at each instant as the excavator links 14, 16, 18, 20 move along some trajectory actuator forces $f_1$, $f_2$, and $f_3$ along hydraulic cylinders 20, 22, 24, at each instant as the excavator links 16, 18, 20 move along some trajectory find: mass (or weight) of the bucket and load The analysis assumes that the excavator chassis 12 is rigidly attached to ground. It is also worth noting that the actuator torque about the first joint axis is not needed in this analysis.

B. Position Analysis

The dynamic equations of motion for the excavator 10 will be generated in terms of a fixed coordinate system that is instantaneously aligned with the xy coordinate system shown in FIGS. 2 and 3. The direction of the gravity vector in terms of this fixed coordinate system can readily be determined in terms of the inclination angle $\xi$ and the rotation angle $\psi$ as $$^{xy}V_{grav}=-\sin\xi\cos\psi i-\cos\xi j-\sin\xi\sin\psi k. \tag{1}$$

From this point onward, the xy coordinate system will refer to the fixed reference frame unless the cab coordinate system is explicitly mentioned.

It is a simple matter to transform the coordinates of points in the boom 16, stick 18, and bucket 20 to the xy coordinate system since the rotation angles $\theta_1$, $\theta_2$, and $\theta_3$ are known quantities. The coordinates of a point H can be determined from an analysis of the planar four bar mechanism G-H-I-$R_3$. These transformation equations are not shown here yet at this point forward it is assumed that the coordinates of all points shown in FIG. 3, with the exception of a point M (the location of the center of mass of the bucket/load), are known in terms of the fixed xy coordinate system.

C. Velocity Analysis

The velocity state of a body j measured with respect to a body i will be written as $$^{i}\hat{T}^{j}=\begin{bmatrix} ^{i}\omega^{j} \\ ^{i}v_{OO}^{j} \end{bmatrix} \tag{2}$$

where $^{i}\omega^{j}$ is the angular velocity of body j measured with respect to the body i and $^{i}v_{OO}^{j}$ is the linear velocity of a point in the body j which is instantaneously coincident with a reference point OO (FIG. 3). Once the velocity state of a body is known, the velocity of any point P in the body may be calculated from $$^{i}v_{P}^{j}=^{i}v_{OO}^{j}+^{i}\omega^{j}\times r_{OO\to P}. \tag{3}$$

Here the term $^{i}v_{P}^{j}$ represents the velocity of a point P in the body j as measured with respect to the body i. The term $r_{OO\to P}$ is the vector from the reference point OO to the point P.

It can be proven that the velocity state of a body k measured with respect to the body i can be determined in terms of the velocity states of the body k with respect to the body j and the body j with respect to the body i as $$^{i}\hat{T}^{k}=^{i}\hat{T}^{j}+^{j}\hat{T}^{k}. \tag{4}$$

From this point on, ground will be referred to as body 0, the cab 14 as body 1, the boom 16 as body 2, the stick 18 as body 3, and the bucket 20 as body 4. The velocity states of each of these bodies will now be determined in terms of the fixed xy reference frame.

It can be shown that for two bodies that are connected by a revolute joint, that the velocity state will equal the magnitude of the angular velocity about the joint times the unitized Plücker coordinates of the joint axis line.

Upon calculating the Plücker line coordinates of the four joint axes in terms of the xy coordinate system by ways known to those skilled in the art, the velocity state of each body of the excavator arm may be determined with respect to body 0 (ground) as $$^{0}\hat{T}^{1}=\begin{bmatrix} ^{0}\omega^{1} \\ ^{0}v_{OO}^{1} \end{bmatrix}=\dot{\psi}\,^{0}\hat{S}^{1}, \tag{5}$$

$$^{0}\hat{T}^{2}=\begin{bmatrix} ^{0}\omega^{2} \\ ^{0}v_{OO}^{2} \end{bmatrix}=\dot{\psi}\,^{0}\hat{S}^{1}+\dot{\theta}_1\,^{1}\hat{S}^{2}, \tag{6}$$

$$^{0}\hat{T}^{3}=\begin{bmatrix} ^{0}\omega^{3} \\ ^{0}v_{OO}^{3} \end{bmatrix}=\dot{\psi}\,^{0}\hat{S}^{1}+\dot{\theta}_1\,^{1}\hat{S}^{2}+\dot{\theta}_2\,^{2}\hat{S}^{3}, \tag{7}$$

$$^{0}\hat{T}^{4}=\begin{bmatrix} ^{0}\omega^{4} \\ ^{0}v_{OO}^{4} \end{bmatrix}=\dot{\psi}\,^{0}\hat{S}^{1}+\dot{\theta}_1\,^{1}\hat{S}^{2}+\dot{\theta}_2\,^{2}\hat{S}^{3}+\dot{\theta}_3\,^{3}\hat{S}^{4} \tag{8}$$

where $$^{0}\hat{S}^{1}=\begin{bmatrix} j \\ 0 \end{bmatrix},\ ^{1}\hat{S}^{2}=\begin{bmatrix} k \\ -x_O j \end{bmatrix},\ ^{2}\hat{S}^{3}=\begin{bmatrix} k \\ ^{2}S_{OO}^{3} \end{bmatrix},\ ^{3}\hat{S}^{4}=\begin{bmatrix} k \\ ^{3}S_{OO}^{4} \end{bmatrix} \tag{9}$$

and where $$^{2}S_{OO}^{3}=[(x_O+a_{12}c_1)i+a_{12}s_1 j]\times k=a_{12}s_1 i-(x_O+a_{12}c_1)j, \tag{10}$$

$$\begin{aligned} ^{3}S_{OO}^{4}&=[(x_O+a_{12}c_1+a_{23}c_{1+2})i+(a_{12}s_1+a_{23}s_{1+2})j]\times k \\ &=(a_{12}s_1+a_{23}s_{1-2})i-(x_O+a_{12}c_1+a_{23}c_{1+2})j \end{aligned} \tag{11}$$

In these equations $s_1$, $c_1$, $s_2$, and $c_2$ represent the sines and cosines of the angles $\theta_1$ and $\theta_2$ respectively. Further, the terms $s_{1+2}$ and $c_{1+2}$ represent the sine and cosine of the sum $\theta_1+\theta_2$.

D. Partial Velocity Screws

The velocity states of each of the moving rigid bodies 1 through 4 are presented in equations (5) through (8). Each of these velocity states will now be factored into the format $$^{0}\hat{T}^{k}=\dot{\psi}\,^{0}\hat{S}_{\psi}^{k}+\dot{\theta}_1\,^{0}\hat{S}_{\theta 1}^{k}+\dot{\theta}_2\,^{0}\hat{S}_{\theta 2}^{k}+\dot{\theta}_3\,^{0}\hat{S}_{\theta 3}^{k},\ k=1.4. \tag{12}$$

The terms $^{0}\hat{S}_{\psi}^{k}$, $^{0}\hat{S}\theta_1^{k}$, $^{0}\hat{S}_{\theta 2}^{k}$, and $^{0}\hat{S}_{\theta 3}^{k}$ are called the partial velocity screws of body k with respect to $\psi$, $\theta_1$, $\theta_2$, and $\theta_3$ respectively and these terms will be used in the subsequent dynamic analysis. The objective here is to express all the partial velocity screws for all of the bodies in terms of known quantities.

From (5) it is apparent that $$^{0}\hat{S}_{\psi}^{1}=^{0}\hat{S}^{1}=\begin{bmatrix} j \\ 0 \end{bmatrix} \tag{13}$$

and ${}^0\hat{S}_{\theta 1}{}^1={}^0\hat{S}_{\theta 2}{}^1={}^0\hat{S}_{\theta 3}{}^1=0$. From (6), the partial velocity screws for body 2 (boom 16) may be written as $$ {}^0\hat{S}_{\psi}^2={}^0\hat{S}^1=\begin{bmatrix} j \\ 0 \end{bmatrix},\ {}^0\hat{S}_{\theta 1}^2={}^1\hat{S}^2=\begin{bmatrix} k \\ -x_O j \end{bmatrix} \tag{14} $$

and ${}^0\hat{S}_{\theta 2}{}^2={}^0\hat{S}_{\theta 3}{}^2=0$. From (7), the partial velocity screws for body 3 (stick 18) may be written as $$ {}^0\hat{S}_{\psi}^3={}^0\hat{S}^1=\begin{bmatrix} j \\ 0 \end{bmatrix},\ {}^0\hat{S}_{\theta 1}^3={}^1\hat{S}^2=\begin{bmatrix} k \\ -x_O j \end{bmatrix},\ {}^0\hat{S}_{\theta 2}^3={}^2\hat{S}^3=\begin{bmatrix} k \\ a_{12}s_1 i-(x_O+a_{12}c_1)j \end{bmatrix} \tag{15} $$

and ${}^0\hat{S}_{\theta 3}{}^3=0$. From (8), the partial velocity screws for body 4 (bucket 20) may be written as $$ {}^0\hat{S}_{\psi}^4={}^0\hat{S}^1=\begin{bmatrix} j \\ 0 \end{bmatrix},\ {}^0\hat{S}_{\theta 1}^4={}^1\hat{S}^2=\begin{bmatrix} k \\ -x_O j \end{bmatrix},\ {}^0\hat{S}_{\theta 2}^4={}^2\hat{S}^3=\begin{bmatrix} k \\ a_{12}s_1 i-(x_O+a_{12}c_1)j \end{bmatrix},\ {}^0\hat{S}_{\theta 3}^4={}^3\hat{S}^4=\begin{bmatrix} k \\ (a_{12}s_1+a_{23}s_{1+2})i-(x_O+a_{12}c_1+a_{23}c_{1+2})j \end{bmatrix}. $$

E. Partial Angular Velocities and Partial Velocities of Points

The concept of partial angular velocities and partial velocities of points are known to those skilled in the art, and may be found in Kane, T., and Levinson, D., "Dynamics: Theory and Applications," McGraw Hill, 1985 and are used in the derivation of Kane's dynamic equations. The quantities can be derived directly from the partial velocity screws derived in the section D which are essentially composed of two parts:

(i) each unit direction vector corresponds to Kane's partial angular velocity.

(ii) each moment vector corresponds to Kane's partial velocity of a point in the body coincident with our reference point OO.

Hence Kane's partial angular velocities and partial velocities of points are in fact vectors. The notation of Kane will now be introduced as it will be used in the derivation of the dynamic equations of motion.

From (13) the partial angular velocity and partial velocity of the point OO due to the generalized coordinate ψ may be written for body 1 (cab 14) as $$ {}^0\omega_{\psi}{}^1=j,\ {}^0v_{OO\psi}{}^1=0 \tag{17} $$

The partial angular velocity and the partial velocity of any point in body 1 (cab 14) relative to body 0 (ground) due to the generalized coordinates $\theta_1$, $\theta_2$, and $\theta_3$ are all zero since these coordinates are 'downstream' of body 1 (cab 14). Hence, $$ {}^0\omega_{\theta 1}{}^1={}^0\omega_{\theta 2}{}^1={}^0\omega_{\theta 3}{}^1={}^0v_{OO\theta 1}{}^1={}^0v_{OO\theta 2}{}^1={}^0v_{OO\theta 3}{}^1=0 \tag{18} $$

For body 2 (boom 16), the partial angular velocities and partial velocities of point OO due to the generalized coordinates ψ and $\theta_1$ are from (14)

$$ {}^0\omega_{\psi}{}^2=j,\ {}^0v_{OO\psi}{}^2=0,\ {}^0\omega_{\theta 1}{}^2=k,\ {}^0v_{OO\theta 1}{}^2=-x_O j. \tag{19} $$

The partial angular velocities and partial velocities of all points in body 2 (boom 16) due to the generalized coordinates $\theta_2$ and $\theta_3$ are zero and thus $$ {}^0\omega_{\theta 2}{}^2={}^0\omega_{\theta 3}{}^2={}^0v_{OO\theta 2}{}^2={}^0v_{OO\theta 3}{}^2=0 \tag{20} $$

For body 3 (stick 18), the partial angular velocities and partial velocities of point OO due to the generalized coordinates ψ, $\theta_1$, $\theta_2$, and $\theta_3$ are from (15)

$$ {}^0\omega_{\psi}{}^3=j,\ {}^0v_{OO\psi}{}^3=0,\ {}^0\omega_{\theta 1}{}^3=k,\ {}^0v_{OO\theta 1}{}^3=-x_O j,\ {}^0\omega_{\theta 2}{}^3=k,\ {}^0v_{OO\theta 2}{}^3=a_{12}s_1 i-(x_O+a_{12}c_1)j,\ {}^0\omega_{\theta 3}{}^3={}^0v_{G3\theta 3}{}^3=0. \tag{21} $$

For body 4 (bucket 20/load), the partial angular velocities and partial velocities of point OO due to the generalized coordinates ψ, $\theta_1$, $\theta_2$, and $\theta_3$ are from (16)

$$ {}^0\omega_{\psi}{}^4=j,\ {}^0v_{OO\psi}{}^4=0,\ {}^0{}_{107\ \theta 1}{}^4=k,\ {}^0v_{OO\theta 1}{}^4=-x_O j, \tag{22} $$

$$ {}^0\omega_{\theta 2}{}^4=k,\ {}^0v_{OO\theta 2}{}^4=a_{12}s_1 i-(x_O+a_{12}c_1)j, \tag{23} $$

$$ {}^0\omega_{\theta 3}{}^4=k,\ {}^0v_{OO\theta 3}{}^4=[a_{12}s_1+a_{23}\sin_{1+2}]i-[x_O+a_{12}c_1+a_{23}c_{1+2}]j. \tag{24} $$

The general equation for the partial velocity of any point P in body i due to the generalized coordinate λ may be written as $$ {}^0v_{P\lambda}{}^i={}^0v_{OO\lambda}{}^i+\dot{\lambda}\,{}^0\omega_{\lambda}{}^i\times r_{OO\to P} \tag{25} $$

Thus (25) can be used to obtain the partial velocity of any point in the excavator arm with respect to any of the generalized coordinates.

The partial velocities of the center of mass point for body 4 (bucket 20/load) will be expanded here however since the location of this point is expressed in terms of the unknown parameters $p_M$ and $q_M$. The coordinates of the center of mass of the bucket 20/load may be written in terms of the xy coordinate system as $$ x_{G4}=p_M c_{1+2+3}-q_M s_{1+2+3}+a_{23}c_{1+2}+a_{12}c_1+x_O,\ y_{G4}=p_M s_{1+2+3}+q_M c_{1+2+3}+a_{23}s_{1+2}+a_{12}s_1. \tag{26} $$

From (22) through (25) the partial velocities of this center of mass point with respect to each of the four generalized coordinates ψ, $\theta_1$, $\theta_2$, and $\theta_3$ may be written as $$ {}^0v_{G4\psi}{}^4=-(p_M c_{1+2+3}-q_M s_{1+2+3}+a_{23}\ c_{1+230\ a12}c_1+x_O)k, \tag{27} $$

$$ {}^0v_{G474\ 1}{}^4=-[p_M s_{1+2+3}+q_M c_{1+2+3}+a_{23}s_{1+2}+a_{12}s_1]i+[p_M c_{1+2+3}-q_M s_{1+2+3}+a_{23}c_{1+2}+a_{12}c_1]j, \tag{28} $$

$$ {}^0v_{G4\theta 2}{}^4=-[p_M s_{1+2+3}+q_M c_{1+2+3}+a_{23}s_{1+2}]i+[p_M c_{1+2+3}-q_M s_{1+2+3}+a_{23}c_{1+2}]j, \tag{29} $$

$$ {}^0v_{G4\theta 3}{}^4=-[p_M s_{1+2+3}+q_M c_{1+2+3}]i+[p_M c_{1+2+3}-q_M s_{1+2+3}]j. \tag{30} $$

Further, the total velocity of the center of mass of body 4 can be written as $$ {}^0v_{G4}{}^4=\dot{\psi}\,{}^0v_{G4\psi}{}^4+\dot{\theta}_1\,{}^0v_{G4\theta 1}{}^4{}_{+\theta 2}\,{}^0v_{G4\theta 2}{}^4+\dot{\theta}_3\,{}^0v_{G4\theta 3}{}^4. \tag{31} $$

From this equation, the velocity of the center of mass of the bucket 20 and load may be written in terms of the unknown parameters $p_M$ and $q_M$ as $$ {}^0v_{G4}^4=p_M\begin{bmatrix} A_1 \\ A_2 \\ A_3 \end{bmatrix}+q_M\begin{bmatrix} A_4 \\ A_5 \\ A_6 \end{bmatrix}+\begin{bmatrix} A_7 \\ A_8 \\ A_9 \end{bmatrix} \tag{32} $$

where $$ A_1={}_{31\ \theta 1+2+3}s_{1+2+3},\ A_2=\dot{\theta}_{1+2+3}\ c_{1+2+3},\ A_3=-\dot{\psi}c_{1+2+3}, $$

$$ A_4=-\dot{\theta}_{1+2+3}c_{1+2+3}=-A_2, $$

$$ A_5=-\dot{\theta}_{1+2+3}s_{1+2+3} $$

$=A_1, A_6=\dot{\psi}s_{1+2+3},$ $A_7=-\dot{\theta}_{1+2}a_{23}$ $s_{1+2}-\dot{\theta}_1 a_{12}\sin\theta_1,$ $A_8=\dot{\theta}_{1+2}a_{23}$ $c_{1+2}+\dot{\theta}_1 a_{12}\cos\theta_1,$ $A_9=-\dot{\psi}(a_{23}$ $c_{1+2}+a_{12}\cos\theta_1+x_O).$ (33)

F. Acceleration Analysis

The acceleration analysis will be performed by specifying the acceleration state of a rigid body using an accelerator or acceleration screw according to ways known to those skilled in the art, and as may be found in Rico, J. M., and Duffy, J., "An Application of Screw Algebra to the Acceleration Analysis of Serial Chains," Mechanism and Machine Theory, Vol. 31, No. 4, May 1996 and Rico, J. M., and Duffy, J., "An Efficient Inverse Acceleration Analysis of In-Parallel Manipulators," Paper 96-DETC-MECH-1005, ASME Design Engineering Technical Conference and Computers in Engineering Conference, Irvine, Calif., 1996. The acceleration state ${}^0\hat{A}_{OO}{}^i$ of a rigid body i with respect to a reference frame or body 0 is given by $${}^0\hat{A}^i_{OO}=\begin{bmatrix}{}^0\alpha^i\\ {}^0a^i_{OO}-{}^0\omega^i\times{}^0v^i_{OO}\end{bmatrix} \tag{34}$$

where ${}^0\alpha^i$ and ${}^0\omega^i$ are respectively the angular acceleration and angular velocity of body i with respect to body 0 and, ${}^0a_{OO}{}^i$ and ${}^0v_{OO}{}^i$ are respectively the acceleration and velocity of a point in body i which is coincident with a reference point OO in body 0.

The acceleration state may also be written in terms of a different reference point. For example, the acceleration state of body i with respect to a reference frame attached to body 0 whose origin is at the point $G_i$ (the center of mass of body i) may be written as $${}^0\hat{A}^i_{Gi}=\begin{bmatrix}{}^0\alpha^i\\ {}^0a^i_{Gi}-{}^0\omega^i\times{}^0v^i_{Gi}\end{bmatrix}. \tag{35}$$

${}^0\hat{A}_{OO}{}^i$ and ${}^0\hat{A}_{Gi}{}^i$ are acceleration screws that are written in terms of different reference points. Because of this, the relationship between these two screws may be written as $${}^0\hat{A}^i_{Gi}={}^0\hat{A}^i_{00}+\begin{bmatrix}0\\ {}^0\alpha^i\times r_{00\to Gi}\end{bmatrix}. \tag{36}$$

Substituting (34) and (35) into (36) and solving for the acceleration of the center of mass point, ${}^0a_{Gi}{}^i$, yields $${}^0a_{Gi}{}^i=({}^0a_{OO}{}^i-{}^0\omega^i\times{}^0v_{OO}{}^i)+{}^0\alpha^i\times r_{OO\to Gi}+{}^0\omega^i\times{}^0v_{Gi}{}^i. \tag{37}$$

Therefore, once the velocity state and acceleration state of body i are known with respect to body 0, the acceleration of any point in body i (particularly the center of mass point $G_i$) may be determined from (37). The acceleration states of bodies 1 through 4 will now be determined.

From (34), the acceleration state of body 1 (cab 14) may be written as $${}^0\hat{A}^1_{00}=\ddot{\psi}{}^0\hat{S}^1=\begin{bmatrix}\ddot{\psi}j\\ 0\end{bmatrix}. \tag{38}$$

From (37), the acceleration of the center of mass of body 1 (cab 14) can be computed as $${}^0a_{G1}{}^1=-\dot{\psi}^2x_Ni-\ddot{\psi}x_Nk. \tag{39}$$

The acceleration state of body 2 (boom 16) with respect to body 1 (cab 14) may be written with respect to the reference point OO as $${}^1\hat{A}^2_{00}=\begin{bmatrix}{}^1\alpha^2\\ {}^1a^2_{00}-{}^1\omega^2\times{}^1v^2_{00}\end{bmatrix}. \tag{40}$$

Since body 2 (boom 16) is constrained to simply rotate about point O, this acceleration state will reduce to the following:

$${}^1\hat{A}_{OO}{}^2=\theta_1{}^1\hat{S}^2 \tag{41}$$

where ${}^1\hat{S}^2$ was defined in (9).

The acceleration state of body 2 (boom 16) with respect to body 0, i.e. ${}^0\hat{A}_{OO}{}^2$, may be written in terms of ${}^0\hat{A}_{OO}{}^1$ and ${}^1\hat{A}_{OO}{}^2$ as $${}^0\hat{A}_{OO}{}^2={}^0\hat{A}_{OO}{}^2+[{}^0\hat{T}^1\ {}^1\hat{T}^2] \tag{42}$$

where $[{}^0\hat{T}^1\ {}^1\hat{T}^2]$ is called the Lie bracket, which is known to those skilled in the art.

The expansion of a Lie bracket is defined for a general case of two velocity screws (both written with respect to the same reference point OO) as $$[{}^i\hat{T}^j\ \ {}^m\hat{T}^n]=\begin{bmatrix}{}^i\omega^j\times{}^m\omega^n\\ {}^i\omega^j\times{}^mv^n_{00}+{}^iv^j_{00}\times{}^m\omega^n\end{bmatrix}. \tag{43}$$

Using (43) to expand (42) gives $${}^0\hat{A}^2_{00}=\begin{bmatrix}{}^0\alpha^2\\ {}^0\alpha^2_{00}-{}^0\omega^2\times{}^0v^2_{00}\end{bmatrix}=\begin{bmatrix}\dot{\psi}\dot{\theta}_1 i+\ddot{\psi}j+\ddot{\theta}_1 k\\ -x_0\ddot{\theta}_1 j\end{bmatrix}. \tag{44}$$

Solving for the acceleration of the center of mass of body 2 (boom 16) gives $${}^0a_{G2}{}^2=a_{G2x}i+a_{G2y}j+a_{G2z}k \tag{45}$$

where $a_{G2x}=-\theta_1y_{G2}-\dot{\psi}^2x_{G2}-\dot{\theta}_1{}^2(x_{G2}-x_O),$ (46)

$a_{G2y}=\theta_1(x_{G2}-x_O)-\dot{\theta}_1{}^2y_{G2},$ (47)

$a_{G2z}=2\dot{\psi}\theta_1y_{G2}-\ddot{\psi}x_{G2}.$ (48)

From a similar procedure the acceleration state of body 3 (stick 18) can be evaluated as $$ {}^{0}\hat{A}_{00}^{3} = \begin{bmatrix} \dot{\psi}\dot{\theta}_{1+2}i + \ddot{\psi}j + \ddot{\theta}_{1+2}k \\ (\ddot{\theta}_2 s_1 + \dot{\theta}_1\dot{\theta}_2 c_1)a_{12}i + \left[-\ddot{\theta}_1 x_0 - \ddot{\theta}_2(a_{12}c_1 + x_0) + \dot{\theta}_1\dot{\theta}_2 a_{12}s_1\right]j - \dot{\psi}\dot{\theta}_2 a_{12}s_1 k_1 \end{bmatrix}. \quad (49) $$

The acceleration of the center of mass of body 3 (stick 18) is given by $$ {}^{0}a_{G3}{}^{3} = a_{G3x}i + a_{G3y}j + a_{G3z}k \quad (50) $$

where $$ a_{G3x} = f[\$]\$^{\cdot\cdot}g\ddot{v}_2 a_{12}s_1 - \dot{\psi}^2 x_{G3} - \theta_{1+2}y_{G3} - \dot{\theta}_{1+2}{}^2(x_{G3} - x_O) + a_{12}c_1(\dot{\theta}_{1+2}\dot{\theta}_2 + \dot{\theta}_1\dot{\theta}_2), \quad (51) $$

$$ a_{G3y} = -\theta_2(a_{12}c_1 + x_O) + \theta_{1+2}x_{G3} - \dot{\theta}_{1+2}{}^2 y_{G3} - \theta_1 x_O + a_{12}s_1(\dot{\theta}_{1+2}\dot{\theta}_2 + \dot{\theta}_1\dot{\theta}_2), \quad (52) $$

$$ a_{G3z} = 2\dot{\psi}\theta_{1+2}y_{G3} - 2\dot{\psi}\theta_2 a_{12}s_1 - \ddot{\psi}x_{G3}. \quad (53) $$

Lastly, the acceleration state of body 4 (bucket 20) is calculated as $$ {}^{0}\hat{A}_{00}^{4} = \begin{bmatrix} \dot{\psi}(\dot{\theta}_1 + \dot{\theta}_2 + \dot{\theta}_3)i + \ddot{\psi}j + (\ddot{\theta}_1 + \ddot{\theta}_2 + \ddot{\theta}_3)k \\ a_{4x}i + a_{4y}j + a_{4z}k \end{bmatrix} \quad (54) $$

where $$ a_{4x} = \theta_2 a_{12}s_1 + \dot{\theta}_1\dot{\theta}_2 a_{12}c_1 + \theta_3(a_{12}s_1 + a_{23}s_{1+2}) + \dot{\theta}_3(\dot{\theta}_{1+2}a_{23}c_{1+2} + \dot{\theta}_1 a_{12}c_1) $$

$$ a_{4y} = -\theta_1 x_O - \theta $$

$$ \mathbf{2}(x_O + a_{12}c_1) + \dot{\theta}_1\dot{\theta}_2 a_{12} $$

$$ s_1 - \theta_3(x_O $$

$$ + a_{12}c_1 + a_{23}c_{1+2}) + \dot{\theta}_3 $$

$$ (\dot{\theta}_{1+2}a_{23}s_{1+2} + \dot{\theta}_1 a_{12}s_1) $$

$$ a_{4z} = -\dot{\psi}(\dot{\theta} $$

$$ \mathbf{2} + \mathbf{3}a_{12}s_1 + \dot{\theta}_3 a_{23}s_{1+2}) \quad (55) $$

where $\dot{\theta}_{2+3} = \dot{\theta}_2 + \dot{\theta}_3$. The acceleration of the center of mass of body 4 (bucket 20) is evaluated in terms of the unknown parameters $p_M$ and $q_M$, the location of the center of mass of the bucket and load in the pq coordinate system, as $$ {}^{0}a_{G4}{}^{4} = a_{G4x}i + a_{G4y}j + a_{G4z}k \quad (56) $$

where $$ a_{g4x} = p_M A_{10} + q_M A_{11} + A_{12} $$

$$ a_{G4y} = p_M A_{13} + q_M A_{14} + A_{15} $$

$$ a_{G4z} = p_M A_{16} + q_M A_{17} + A_{18} \quad (57) $$

and where the terms $A_{10}$ through $A_{18}$ are defined as $$ A_{10} = \dot{\psi}A_3 - \dot{\theta}_{1+2+3}A_2 - \theta_{1+2+3}s_{1+2+3} $$

$$ A_{11} = \dot{\psi}A_6 - \dot{\theta}_{1+2+3}A_1 - \theta_{1+2+3}c_{1+2+3} $$

$$ A_{12} = a_{4x} + \dot{\psi}A_9 - \theta_{1+2+3}(a_{23}s_{1+2} + a_{12}s_1) - \dot{\theta}_{1+2+3}A_8 \quad (58) $$

$$ A_{13} = \dot{\theta}_{1+2+3}A_1 + \theta_{1+2+3}c_{1+2+3} $$

$$ A_{14} = -\dot{\theta}_{1+2+3}A_2 - \theta_{1+2+3}s_{1+2+3} $$

$$ A_{15} = a_{4y} + \theta_{1+2+3}(a_{23}c_{1+2} + a_{12}c_1 + x_o) + \dot{\theta}_{1+2+3}A_7 \quad (59) $$

$$ A_{16} = \dot{\psi}\dot{\theta}_{1+2+3}s_{1+2+3} - \ddot{\psi}c_{1+2+3} - \dot{\psi}A_1 $$

$$ A_{17} = \dot{\psi}\dot{\theta}_{1+2+3}c_{1+2+3} - \ddot{\psi}s_{1+2+3} - \dot{\psi}A_2 $$

$$ A_{18} = a_{4z} + \dot{\psi}\dot{\theta}_{1+2+3}(a_{23}s_{1+2} + a_{12}s_1) - \dot{\psi}(a_{23}c_{1+2} + a_{12}c_1 + x_o) - \dot{\psi}A_7 \quad (60) $$

The terms $a_{4x}$, $a_{4y}$, and $a_{4z}$, are defined in (55) and the terms $A_1$ through $A_9$ are defined in (33).

The linear acceleration of the center of mass of the cab 14, boom 16, and stick 18 have been determined in terms of the given parameters. The linear acceleration of the center of mass of the bucket 20, however, is written in terms of the unknown parameters $p_M$ and $q_M$ which specify the location of the bucket center of mass point in the pq coordinate system.

3. PART II: DYNAMIC ANALYSIS

A. Introduction

Figure 5:
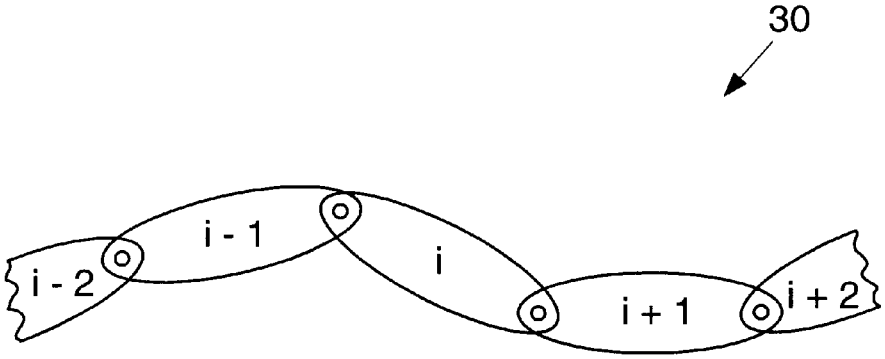
FIG. 5 is a serial chain according to one embodiment of the invention.
Figure 6:
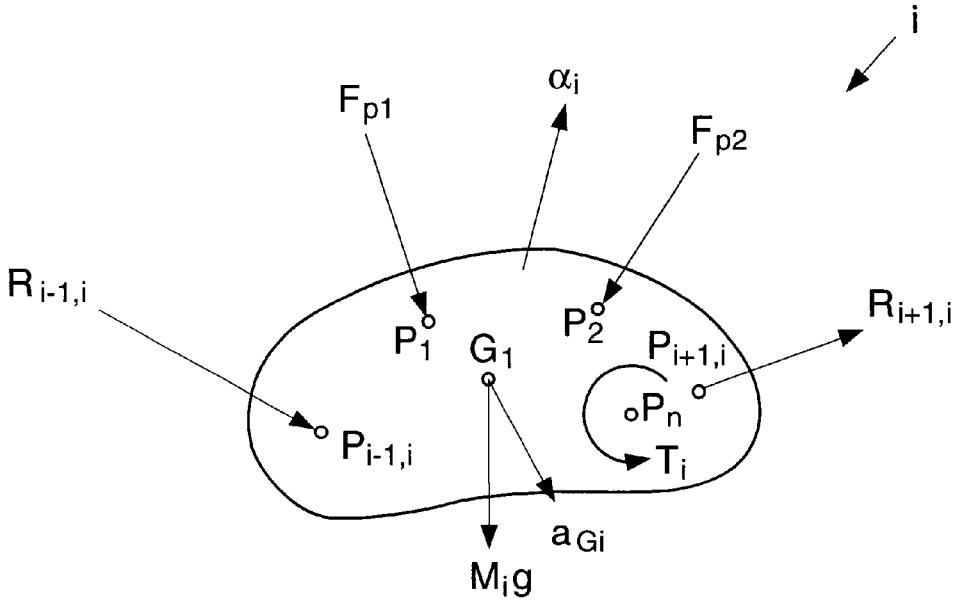
FIG. 6 shows link i in a serial chain and the forces and torques that are acting on it according to one embodiment of the invention.

A brief introduction is presented here on the dynamic analysis of multi-body systems developed by Kane. A serial chain 30 is shown according to one embodiment of the invention in FIG. 5. FIG. 6 shows link i and the forces and torques that are acting on it according to one embodiment of the invention. These forces and torques can be classified as external forces such as $R_{i-1,i}$, $R_{i+1,i}$, $F_{P1}$, $F_{P2}$, . . . , $T_i$, and $M_i g$, with g being the force of gravity, and inertia forces also known as D'Alembert forces.

From the Newton-Euler equations known to those skilled in the art $$ \Sigma F_{iEXT} - M_i a_{Gi} = 0, \quad (61) $$

$$ \Sigma T_{iEXT} - I_i a_{Gi} = 0. \quad (62) $$

The term $\Sigma F_{iEXT}$ is equal to the sum of the external forces applied to link i and the term $\Sigma T_{iEXT}$ is equal to the sum of the moments due to the external forces with respect to point $G_i$. Further the terms $F_i^*$ and $T_i^*$ are now introduced to represent the inertia force due to the motion of link i (D'Alembert force) and the inertia torque due to the motion of link i (D'Alembert torque). Thus $$ F_i^* = -M_i a_{Gi} \quad (63) $$

$$ T_i^* = -I_{Gi}\alpha_i \quad (64) $$

and equations (61) and (62) may be written as $$ \Sigma F_{iEXT} + F_i^* = 0, \quad (65) $$

$$ \Sigma T_{iEXT} + T_i^* = 0. \quad (66) $$

A multi-body system has many degrees of freedom and for 10 simplicity in this introduction we will consider only one of these degrees of freedom, a rotation θ of one of the revolute pairs in the chain. Now θ is called a generalized coordinate and further, the angular speed ω is given by $$\omega = \frac{d\theta}{dt}. \tag{67}$$

It follows that the velocity for any point P fixed in link i with respect to an inertial reference frame 0 is given by $$^0v_P{}^i = \ldots + {}^0U_P{}^i\omega + \ldots \tag{68}$$

and the angular velocity of link i with respect to the inertial reference frame is given by $$^0\omega^1 = \ldots + {}^0U^i\omega + \ldots \tag{69}$$

The vector $^0U_P{}^i$ is called the partial velocity of point P fixed in link i with respect to the generalized coordinate θ while the vector $^0U^i$ is called the partial angular velocity of link i with respect to the generalized coordinate θ. The remaining terms in the summations of equations (68) and (69) will be the partial velocities and partial angular velocities multiplied by the time derivative of the other generalized coordinates of the system.

The active force associated with link i with respect to the generalized coordinate θ is defined as $$F_i = \Sigma^0 F_{Pi}{}^{i.0}U_P{}^i + \Sigma^0 T^{i.0}U^i \tag{70}$$

and the inertia force associated with link i with respect to the generalized coordinate θ is defined as $$F_i{}^* = -M_1{}^0 a_{Gi}{}^{i.0}U_{Gi}{}^i - I_{Gi}\alpha_1{}^{.0}U^i. \tag{71}$$

The dynamical equation of the serial chain associated with the generalized coordinate θ is then given by $$\sum_{i=1}^{n} F_i + \sum_{i=1}^{n} F_i^* = 0 \tag{72}$$

where i=1,2, . . . , n represents each of the n links in the serial chain.

Following Kane's method, there is a dynamical equation of motion associated with each of the generalized coordinates ψ, $\theta_1$, $\theta_2$, and $\theta_3$. From (72) these equations may be written in the form $$\sum_{i=1}^{4} F_{i\psi} + \sum_{i=1}^{4} F_{i\psi}^* = 0, \tag{73}$$

$$\sum_{i=1}^{4} F_{i\theta 1} + \sum_{i=1}^{4} F_{i\theta 1}^* = 0, \tag{74}$$

$$\sum_{i=1}^{4} F_{i\theta 2} + \sum_{i=1}^{4} F_{i\theta 2}^* = 0, \tag{75}$$

$$\sum_{i=1}^{4} F_{i\theta 3} + \sum_{i=1}^{4} F_{i\theta 3}^* = 0. \tag{76}$$

Here the terms F and F* are the active and inertia forces which are derived in the next section. Expanding equation (73) will show that it contains unwanted and unknown inertia terms of the bucket that cannot be eliminated using equations (74) through (76). For this reason this equation will not be used and its expansion is not developed further.

B. Generalized Inertia Forces

In the notation developed by Kane, the terms $F_n{}^*$ and $T_n{}^*$ are defined respectively as the inertia force and inertia torque of a body n measured with respect to ground (body 0). These terms are written as $$F_n{}^* = -M_n{}^0 a_{Gn}{}^n \tag{77}$$

$$T_n{}^* = -I_n o^0\alpha^n - {}^0\omega^n \times (I_n o^0\omega^n) \tag{78}$$

where $M_n$ is the mass of the body, $^0a_{Gn}{}^n$ is the acceleration of the center of mass point, and $^0\omega^n$ and $^0\alpha^n$ are the angular velocity and angular acceleration of the body measured with respect to ground. $I_n$ is the inertia dyadic for this body and it may be written as $$\begin{aligned} I_n &= \begin{bmatrix} I_{xx}^n & I_{xy}^n & I_{xz}^n \\ I_{yx}^n & I_{yy}^n & I_{yz}^n \\ I_{zx}^n & I_{zy}^n & I_{zz}^n \end{bmatrix} \\ &= (I_{xx}^n i + I_{xy}^n j + I_{xz}^n k)i + (I_{yx}^n i + I_{yy}^n j + I_{yz}^n k)j + \\ &\quad (I_{zx}^n i + I_{zy}^n j + I_{zz}^n k)k. \end{aligned} \tag{79}$$

The angular velocity and angular acceleration may be written as $$^0\omega^n = {}_0\omega_{nx} i + {}_0\omega_{ny} j + {}_0\omega_{nz} k \tag{80}$$

$$^0\alpha^n = {}_0\alpha_{nx} i + {}_0\alpha_{ny} j + {}_0\alpha_{nz} k. \tag{81}$$

The product $I_n o^0\alpha^n$ may now be written as $$\begin{aligned} I_n \circ^0 \alpha^n &= (I_{xx}^n i + I_{xy}^n j + I_{xz}^n k)_0\alpha_{nx} + (I_{yx}^n i + I_{yy}^n j + I_{yz}^n k)_0\alpha_{ny} + \\ &\quad (I_{zx}^n i + I_{zy}^n j + I_{zz}^n k)_0\alpha_{nz} \\ &= (I_{xx}^n {}_0\alpha_{nx} + I_{yx}^n {}_0\alpha_{ny} + I_{zx}^n {}_0\alpha_{nz})i + \\ &\quad (I_{xy}^n {}_0\alpha_{nx} + I_{yx}^n {}_0\alpha_{ny} + I_{zy}^n {}_0\alpha_{nz})j + \\ &\quad (I_{xz}^n {}_0\alpha_{nx} + I_{yz}^n {}_0\alpha_{ny} + I_{zz}^n {}_0\alpha_{nz}) \end{aligned} \tag{82}$$

Similarly, the product $I_n o^0\omega^n$ may be written as $$\begin{aligned} I_n o^0\omega^n &= (I_{xx}{}^n{}_0\omega_{nx} + I_{yx}{}^n{}_0 \\ &\quad \omega_{ny} + I_{zx}{}^n{}_0\omega_{nz})i \\ &\quad + (I_{xy}{}^n{}_0\omega_{nx} + I_{yy}{}^n{}_0\omega_{ny} + I_{zy}{}^n{}_0 \\ &\quad \omega_{nz})j + (I_{xz}{}^n{}_0\omega_{nx} + I_{yz}{}^n{}_0 \\ &\quad \omega_{ny} + I_{zz}{}^n{}_0\omega_{nz})k \end{aligned} \tag{83}$$

The term $^0\omega^n \times (I_n o^0\omega^n)$ may now be written as $$\begin{aligned} {}^0\omega^n \times (I_n \circ^0 \omega^n) &= \begin{bmatrix} {}_0\omega_{ny}(I_{xz}^n {}_0\omega_{nx} + I_{yz}^n {}_0\omega_{ny} + I_{zz}^n {}_0\omega_{nz}) - \\ {}_0\omega_{nz}(I_{xy}^n {}_0\omega_{nx} + I_{yy}^n {}_0\omega_{ny} + I_{zy}^n {}_0\omega_{nz}) \end{bmatrix} i + \\ &\quad \begin{bmatrix} {}_0\omega_{nz}(I_{xx}^n {}_0\omega_{nx} + I_{yx}^n {}_0\omega_{ny} + I_{zx}^n {}_0\omega_{nz}) - \\ {}_0\omega_{nx}(I_{xz}^n {}_0\omega_{nx} + I_{yz}^n {}_0\omega_{ny} + I_{zz}^n {}_0\omega_{nz}) \end{bmatrix} j + \\ &\quad \begin{bmatrix} {}_0\omega_{nx}(I_{xy}^n {}_0\omega_{nx} + I_{yy}^n {}_0\omega_{ny} + I_{zy}^n {}_0\omega_{nz}) - \\ {}_0\omega_{ny}(I_{xx}^n {}_0\omega_{nx} + I_{yx}^n {}_0\omega_{ny} + I_{zx}^n {}_0\omega_{nz}) \end{bmatrix} k \end{aligned} \tag{84}$$

Substituting (82) and (84) into (78) gives $$\begin{aligned} T_n{}^* &= [-(I_{xx}{}^n{}_0\alpha_{nx} + I_{yx}{}^n{}_0\alpha \\ &\quad \text{ny} + I_{zx}{}^n{}_0\alpha_{nz}) - \\ &\quad {}_0\omega_{ny}(I_{xz}{}^n{}_0\omega_{nx} + I_{yz}{}^n{}_0\omega \\ &\quad \text{ny} + I_{zz}{}^n{}_0\omega_{nz}) + \\ &\quad {}_0\omega_{nz}(I_{xy}{}^n{}_0\omega_{nx} + I_{yy}{}^n{}_0\omega \end{aligned}$$

$$ny+I_{zy}{}^{n}{}_{0}\omega_{nz})]j+$$

$$[-(I_{xy}{}^{n}{}_{0}\alpha_{nx}+I_{yy}{}^{n}{}_{0}\alpha$$

$$ny+I_{zy}{}^{n}{}_{0}\alpha_{nz})-$$

$$_{0}\omega_{nz}(I_{xx}{}^{n}{}_{0}\omega_{nx}+I_{yx}{}^{n}{}_{0}\omega$$

$$ny+I_{zx}{}^{n}{}_{0}\omega_{nz})+$$

$$_{0}\omega_{nx}(I_{xz}{}^{n}{}_{0}\omega_{nx}+I_{yz}{}^{n}{}_{0}\omega$$

$$ny+I_{zz}{}^{n}{}_{0}\omega_{nz})]j$$

$$+[-(I_{xz}{}^{n}{}_{0}\alpha_{nx}+I_{yz}{}^{n}{}_{0}\alpha$$

$$ny+I_{zz}{}^{n}{}_{0}\alpha_{nz})-$$

$$_{0}\omega_{nx}(I_{xy}{}^{n}{}_{0}\omega_{nx}+I$$

$$yy^{n}{}_{0}\omega_{ny}+I_{zy}{}^{n}{}_{0}\omega_{nz})+$$

$$_{0}\omega_{ny}(I_{xx}{}^{n}{}_{0}\omega_{nx}+I$$

$$yx^{n}{}_{0}\omega_{ny}+I_{zx}{}^{n}{}_{0}\omega_{nz})]k. \tag{85}$$

B.1 Generalized Inertia Forces for Body 1, Cab

Although the inertia force of body 1 with respect to the generalized coordinate $\psi$ will be non-zero, this term will not be evaluated here since equation (73) will not be used. Since the partial angular velocities and partial linear velocities of body 1 with respect to the remaining generalized coordinates $\theta_1$, $\theta_2$, and $\theta_3$ all equal zero, the inertia forces for body 1 with respect to these generalized coordinates will also equal zero and thus $$F_{1\theta 1}{}^{*}=F_{1\theta 2}{}^{*}=F_{1\theta 3}{}^{*}=0 \tag{86}$$

B.2 Generalized Inertia Forces for Body 2, Boom

The inertia force for body 2 (boom 16) with respect to the generalized coordinate $\theta_1$ is given by $$F_{2\theta 1}{}^{*}={}^{0}\omega_{\theta 1}{}^{2}\cdot T_2{}^{*}+{}^{0}v_{G2\theta 1}{}^{2}\cdot F_2{}^{*}. \tag{87}$$

The term $T_2{}^{*}$ can be obtained from (85). However it is important to note here that the moment of inertia terms at each instant must be expressed in terms of a coordinate system that is parallel to the xyz coordinate system and whose origin is coincident with the center of mass of body 2. The moment of inertia terms for body 2, however, were given in terms of a coordinate system parallel to the st coordinate system whose origin is located at the center of mass. The st coordinate system can be brought parallel to the xy coordinate system by rotating an angle of $-\theta_1$ about the z axis. The rotation matrix that transforms a point from the st coordinate system to the xy coordinate system is named ${}_{st}{}^{xy}R$ and can be written as $$ {}_{st}^{xy}R=\begin{bmatrix}\cos\theta_1 & -\sin\theta_1 & 0\\ \sin\theta_1 & \cos\theta_1 & 0\\ 0 & 0 & 1\end{bmatrix}. \tag{88}$$

This matrix can be used to transform the inertia tensor in terms of the st coordinate system, i.e. $I_{stz}$, to the inertia tensor in terms of the xy coordinate system, i.e. $I_{xyz}$, according to the relation $$I_{xyz}={}_{st}{}^{xy}RI_{stz}\,{}_{st}{}^{xy}R^{T}. \tag{89}$$

$$I_{yy}=I_{ss}\sin^2\theta_1+I_{tt}\cos^2\theta_1+2\sin\theta_1\cos\theta_1 I_{st}, \tag{91}$$

$$I_{xy}=(-I_{tt}+I_{ss})\sin\theta_1\cos\theta_1+I_{st}(\cos^2\theta_1-\sin^2\theta_1), \tag{92}$$

$$I_{xz}=I_{sz}\cos\theta_1-I_{tz}\sin\theta_1, \tag{93}$$

$$I_{yz}=I_{sz}\sin\theta_1+I_{tz}\cos\theta_1, \tag{94}$$

The moment of inertia term $I_{zz}$ remains unchanged.

Finally, expansion of (87) will yield $$F_{2\theta 1}{}^{*}=-(I_{xz}{}^{2}\dot{\psi}\dot{\theta}_1+I_{yz}{}^{2}\ddot{\psi}+I_{zz}{}^{2}\theta_1)+\dot{\psi}(I_{yx}{}^{2}\dot{\psi}+I_{zx}{}^{2}\dot{\theta}_1)-M_2[-y_{G2}a_{G2x}+(x_{G2x}-x_o)a_{G2y}]. \tag{95}$$

B.3 Generalized Inertia Forces for Body 3, Stick

As in the previous section, the moment of inertia terms for body 3 (stick 18) which are given in terms of the uv coordinate system, must be determined in terms of the xy coordinate system. This is accomplished in a manner similar as before where now the uv coordinate system can be brought parallel to the xy coordinate system by rotating an angle of $-(\theta_1+\theta_2)$ about the z axis.

Solving for the inertia force for body 3 with respect to the generalized coordinate $\theta_1$ yields $$F_{3\theta 1}{}^{*}=-(I_{-xz}{}^{3}\dot{\psi}\dot{\theta}_{1+2}+I_{yz}{}^{3}\ddot{\psi}I_{zz}{}^{3}\theta_{1+2})+\dot{\psi}(I_{yx}{}^{3}\dot{\psi}+I_{zx}{}^{3}\dot{\theta}_{1+2})-M_3[-y_{G3}a_{G3x}+(x_{G3}-x_o)a_{G3y}] \tag{96}$$

The inertia force for body 3 with respect to the generalized coordinate $\theta_2$ is given by $$F_{3\theta 2}{}^{*}=F_{3\theta 1}{}^{*}-M_3(a_{12}s_1a_{G3x}-a_{12}c_1a_{G3y}). \tag{97}$$

where $a_{G3x}$ and $a_{G3y}$ are given in (51) and (52).

Lastly, the inertia forces for body 3 with respect to the generalized coordinate $\theta_3$ will equal zero since the partial angular velocity and partial velocity of the center of mass with respect to $\theta_3$ both equal zero. Thus $$F_{3\theta 3}{}^{*}=0. \tag{98}$$

B.4 Generalized Inertia Forces for Body 4, Bucket

A similar procedure as was used for bodies 2 and 3 is utilized here to obtain the inertia forces for body 4 (bucket 20) with respect to the generalized coordinates $\theta_1$, $\theta_2$, and $\theta_3$. The results of this procedure are presented here as follows:

$$F_{4\theta 1}{}^{*}=-(I_{xz}{}^{4}\dot{\psi}\dot{\theta}_{1+2+3}+I_{yz}{}^{4}\ddot{\psi}I_{zz}{}^{4}\theta_{1+2+3})+\dot{\psi}(I_{yx}{}^{4}\dot{\psi}+I_{zx}{}^{4}\dot{\theta}_{1+2+3})-$$

$$M_4\{-(p_Ms_{1+2+3}+q_Mc_{1+2+3}+a_{23}s_{1+2}+a$$

$$(A_{10}p_M+A_{11}q_M+A_{12})+$$

$$+(p_Mc_{1+2+3}-q_Ms_{1+2+3}+a_{23}c_{1+2}+a_{12}c_1)($$

$$A_{13}p_M+A_{14}q_M+A_{15})\}, \tag{99}$$

$$F_{4\theta 2}{}^{*}=F_{4\theta 1}{}^{*}-M_4\{a_{12}s_1$$

$$(A_{10}p_M+A_{11}q_M+A_{12})$$

$$-a_{12}c_1(A_{13}p_M+A_{14}q_M+A_{15})\}, \tag{100}$$

$$F_{4\theta 3}{}^{*}=F_{4\theta 2}{}^{*}-M_4\{a_{23}s_{1+2}$$

$$(A_{10}p_M+A_{11}q_M+A_{12})$$

$$_{31}\ a_{23}c_{1+2}(A_{13}p_M+A_{14}q_M+A_{15})\}. \tag{101}$$

In these equations the terms $p_M$ and $q_M$ represent the unknown location of the center of mass of the bucket 20/load measured in terms of the pq coordinate system. The terms $A_{10}$ through $A_{15}$ are defined in (58) and (59). Lastly, it is important to note that the moments of inertia of body 4 (bucket 20) are not known in the pq coordinate system and are therefore not known in the xy coordinate system.

C. Generalized Active Forces

The generalized active force for a body n with respect to a generalized coordinate $\lambda$ can be obtained as the sum of each external force projected onto the partial linear velocity (with respect to the generalized coordinate $\lambda$) of a point on the line of action of the force. For example, if body n had two external forces $F_1$ and $F_2$ applied where these forces passed through the points A and B respectively, then the generalized active force for body n with respect to the generalized coordinate X could be written as $$F_{n\lambda}=F_1\cdot{}^0v_{A\lambda}{}^n+F_2\cdot{}^0v_{B\lambda}{}^n. \tag{102}$$

where ${}^0v_{A\lambda}{}^n$ and ${}^0v_{B\lambda}{}^n$ are the partial linear velocities of points A and B in body n with respect to the generalized coordinate $\lambda$. The active forces for bodies 1 through 4 will now be determined for the excavator with respect to the generalized coordinates $\theta_1$, $\theta_2$, and $\theta_3$.

C.1 Generalized Active Forces for Body 1, Cab

The partial angular velocities and partial linear velocities of body 1 (cab 14) with respect to the generalized coordinates $\theta_1$, $\theta_2$, and $\theta_3$ are all zero. For this reason, the generalized active forces will also equal zero and thus $$F_{1\theta 1}=F_{1\theta 2}=F_{1\theta 3}=0. \tag{103}$$

C.2 Generalized Active Forces for Body 2, Boom

Three external forces are acting on body 2 (boom 16). These are the weight of body 2 which passes through point J (also referred to as point $G_2$), the actuator force applied between points A and B, and the actuator force applied between points D and E. Therefore, the generalized active force for body 2 with respect to the generalized coordinate $\theta_i$ may be written as $$F_{2\theta i}=W_2\cdot{}^0v_{G2\theta i}{}^2+F_{2B}\cdot{}^0v_{B\theta i}{}^2+F_{2D}\cdot{}^0v_{D\theta i}{}^2 \tag{104}$$

where $W_2$ is the weight of body 2 (boom 16), $F_{2B}$ and $F_{2D}$ are the cylinder forces, and ${}^0v_{G2\theta i}{}^2$, ${}^0v_{B\theta i}{}^2$, and ${}^0v_{D\theta i}{}^2$ are the partial velocities of points $G_2$, B, and D with respect to the generalized coordinate $\theta_i$. The resulting generalized active forces with respect to the generalized coordinate $\theta_1$ is presented here as $$F_{2\theta 1}=M_2g\,[\sin\xi\cos\psi y_{G2}-\cos\xi(x_{G2}-x_O)]+F_{AB}[-u_{ABx}y_B+u_{ABy}(x_B-x_O)]+F_{ED}[-u_{EDx}y_D+u_{EDy}(x_D-x_O)],\text{ where g is the gravitational acceleration.} \tag{105}$$

Since the partial velocity screws of body 2 (boom 16) with respect to $\theta_2$ and $\theta_3$ equal zero, the generalized active forces for body 2 with respect to these coordinates will also equal zero. Thus $$F_{2\theta 2}=F_{2\theta 3}32\ 0. \tag{106}$$

C.3 Generalized Active Forces for Body 3, Stick

Four external forces are acting on body 3 (stick 18). These are the weight of body 3 which passes through point K (also referred to as-point $G_3$), the actuator force applied between points D and E, the actuator force applied between points F and H, and the force along the link between the points G and H. Therefore, the generalized active force for body 3 (stick 18) with respect to the generalized coordinate $\theta_i$ may be written as $$F_{3\theta i}=W_3\cdot{}^0v_{G3\theta i}{}^3+F_{3E}\cdot{}^0v_{E\theta i}+F_{3F}\cdot{}^0v_{F\theta i}{}^3+F_{3G}\cdot{}^0v_{G\theta i}{}^3 \tag{107}$$

where $W_3$ is the weight of body 3 (stick 18), $F_{3E}$ and $F_{3F}$ are the cylinder forces, $F_{3G}$ is the force along link GH, and ${}^0v_{G\theta i}{}^3$, ${}^0v_{E\theta i}{}^3$, ${}^0v_{F\theta i}{}^3$, and ${}^0v_{G\theta i}{}^3$ are the partial velocities of points $G_3$, E, F, and G with respect to the generalized coordinate $\theta_i$. The resulting generalized active forces with respect to the generalized coordinates $\theta$1and $\theta_2$ are presented here as $$F_{3\theta 1}=M_3g[\sin\xi\cos\psi y_{G3}-\cos\xi(x_{G3}-x_O)]-F_{DE}(-y_Eu_{EDx}+(x_E-x_O)u_{EDy})$$

$$+F_{HF}(-y_Fu_{HFx}+(x_F-x_O)u_{HFy})+F_{HG}(-y_Gu_{HGx}+(x_G-x_O)u_{HGy}), \tag{108}$$

$$F_{3\theta 2}=F_{3\theta 1}+a_{12}s_1(-M_3g\sin\xi\cos\psi+F_{DE}u_{Dex}+F_{HF}u_{HFx}+F_{HG}u_{HGx})-a_{12}c_1(-M_3g\cos\xi+F_{DE}u_{DEy}+F_{HF}u_{HFy}+F_{HG}u_{HGy}). \tag{109}$$

Since the partial velocity screws of body 3 with respect to $\theta_3$ equal zero, the generalized active force for body 3 with respect to $\theta_3$ will also equal zero. Thus $$F_{3\theta 3}=0. \tag{110}$$

C.4 Generalized Active Forces for Body 4, Bucket

Two external forces are acting on body 4 (bucket 20). These are the weight of body 4 which passes through point M (also referred to as point $G_4$) and the force along the link between the points H and I. Therefore, the generalized active force for body 4 with respect to the generalized coordinate $\theta_i$ may be written as $$F_{4\theta i}=W_4\cdot{}^0v_{G4\theta i}{}^4+F_{31}\cdot{}^0v_{1\theta i}{}^4 \tag{111}$$

where $W_4$ is the weight of body 4, $F_{31}$ is the force along link HI, and ${}^0v_{G4\theta i}{}^4$ and ${}^0v_{I\theta i}{}^4$ are the partial velocities of points $G_4$ and I with respect to the generalized coordinate $\theta_i$. The resulting generalized active forces with respect to the generalized coordinates $\theta_1$, $\theta_2$, and $\theta_3$ are presented here as $$F_{4\theta 1}=M_4g[(p_Ms_{1+2+3}+q\,Mc_{1+2+3}+a_{23}s_{1+2}+a_{12}s_1)\sin\xi\cos\psi-(p_Mc_{1+2+3}-q_Ms_{1+2+3}+a_{23}c_{1+2}+a_{12}c_1)\cos\xi]+F_{HI}(-y_Iu_{HIx}+(x_1-x_O)u_{HIy}), \tag{112}$$

$$F_{4\theta 2}=F_{4\theta 1}-M_4g[a_{12}s_1\sin\xi\cos\psi-a_{12}c_1\cos\xi]+F_{HI}(a_{12}s_1u_{HIx}-a_{12}c_1u_{HIy}), \tag{113}$$

$$F_{4\theta 3}=F_{4\theta 2}-M_4g[a_{23}s_{1+2}\sin\xi\cos\psi-a_{23}c_{1+2}\cos\xi]+F_{HI}(a_{23}s_{1+2}u_{HIx}-a_{23}c_{1+2}u_{HIy}). \tag{114}$$

D. Formulation of the Equations of Motion

Equations (73) through (76) presented the equations of motion for the excavator arm. The first of these equations will not be used as it contains many unknown moment of inertia terms for the bucket 20. The three remaining equations can be written as follows after substituting for the zero valued generalized inertia and active forces:

$$F_{2\theta 1}+F_{3\theta 1}+F_{4\theta 1}+F_{2\theta 1}{}^*+F_{3\theta 1}{}^*+F_{4\theta 1}{}^*=0, \tag{115}$$

$$F_{3\theta 2}+F_{4\theta 2}+F_{3\theta 2}{}^*+F_{4\theta 2}{}^*=0, \tag{116}$$

$$F_{4\theta 3}+F_{4\theta 3}{}^*=0. \tag{117}$$

In order to solve equations (115) through (117) for the weight of the bucket 20 we will form (115) minus (116) and (116) minus (117) which eliminates the unknown inertia terms of the bucket 20/load, i.e. $I_{xx}^4$, $I_{xy}^4$, $I_{xz}^4$, $I_{yy}^4$, $I_{yz}^4$, and $I_{zz}^4$, and we obtain $$F_{2\theta 1}+(F_{3\theta 1}-F_{3\theta 2})+(F_{4\theta 1}-F_{4\theta 2})+F_{2\theta 1}^*+(F_{3\theta 1}^*-F_{3\theta 2}^*)+(F_{4\theta 1}^*-F_{4\theta 2}^*)=0, \tag{118}$$

$$F_{3\theta 2}+(F_{4\theta 2}-F_{4\theta 3})+F_{3\theta 2}^*+(F_{4\theta 2}^*-F_{4\theta 3}^*)=0. \tag{119}$$

Without this major simplification of the problem a viable solution does not appear to be possible and essentially it occurs because the second, third, and fourth joint axes are all parallel. This was not apparent at the outset.

Using (105), (95), (109), (113), (97), and (100) to expand (118) and (109), (108), (97), (96), and (100) to expand (119) results in the following two equations in the three unknown parameters $M_4$, $p_M$, and $q_M$ $$B_1M_4+D_1M_4p_M+E_1M_4q_M+F_1=0, \tag{120}$$

$$B_2M_4+D_2M_4p_M+E_2M_4q_M+F_2=0 \tag{121}$$

where (58) through (60) and (33) were substituted into the coefficients to yield $$\begin{aligned}
B_1=&g(a_{12}s_1 \sin \xi \cos \psi-a_{12}c_1 \cos \xi)+a_{12}[(a_{4x}s_1-a_{4y}c_1)-\\
&\dot{\psi}^s s_1(a_{23}c_{1+2}+a_{12}c_1+x_O)-\theta_{1+2+3}(a_{23}c_2+a_{12}+\\
&x_O c_1)+\dot{\theta}_{1+2+3}\\
&\dot{\theta}_{1+2}a_{23}s_2],\\
D_1=&a_{12}[-\dot{\psi}^2 c_{1+2+3}\\
&s_1+\dot{\theta}_{1+2+3}{}^2 s_{2+3}-\theta_{1+2+3}c_{2+3}],\\
E_1=&a_{12}[\dot{\psi}^2 s_{1+2+3}\\
&s_{1+\theta 1+2+3}{}^2 c_{2+3}+\theta_{1+2+3}s_{2+3}],\\
F_1=&F_{2\theta 1}+F_{2\theta 1}^*+(\\
&F_{3\theta 1}-F_{3\theta 2})+(F_{3\theta 1}^*-F_{3\theta 2}^*)-\\
&F_{HI}a_{12}(s_1u_{HIx}-c_1u_{HIy}),\\
B_2=&g(a_{23}s_{1+2} \sin \xi \cos \psi-a_{23}c_{1+2} \cos \xi)+\\
&a_{23}[(a_{4x}s_{1+2}-a_{4y}c_{1+2})-\dot{\psi}^2 s_{1+2}(a_{23}c_{1+2}+a_{12}c_1+x_O)-\\
&\theta_{1+2+3}(a_{23}+a_{12}c_2+x_O\\
&c_{1+2})-\dot{\theta}_{1+2+3}\dot{\theta}_1\\
&a_{12}s_2],
\end{aligned} \tag{122}$$

$$\begin{aligned}
D_2=&a_{23}[-\dot{\psi}^2 c_{1+2+3}\\
&s_{1+2}+\dot{\theta}_{1+2+3}{}^2\\
&s_3-\theta_{1+2+3}c_3],\\
E_2=&a_{23}[\dot{\psi}^2 s_{1+2+3}\\
&s_{1+2}+\dot{\theta}_{1+2+3}{}^2 c_3+\theta_{1+2+3}s_3],\\
F_2=&F_{3\theta 2}+F_{3\theta 2}^*-F_{HI}a_{23}\\
&(s_{1+2}u_{HIx}-c_{1+2}u_{HIy}).
\end{aligned}$$

E. Determination of Bucket/Load Weight from Multiple Data Sets $$B_1+D_1p_M+E_1q_M+\frac{F_1}{M_4}=0, \tag{123}$$

$$B_2+D_2p_M+E_2q_M+\frac{F_2}{M_4}=0. \tag{124}$$

Eliminating $q_M$ yields $$H_ip_M+J_i\frac{1}{M_4}+K_i=0,\ i=1\ \ldots\ n \tag{125}$$

where $$H_i=D_2E_1-D_1E_2,$$

$$J_i=F_2E_1-F_1$$

$$E_2,\ K_i=B_2E_1-B_1E_2.$$

The subscript i is used to represent multiple data sets, i.e. data that is collected at each instant of time.

Equation (125) may be written in matrix form as $$Ax=b, \tag{127}$$

where A is an n×2 matrix, x is a length 2 vector, and b is a length n vector given by $$A=\begin{bmatrix} H_1 & J_1 \\ H_2 & J_2 \\ \vdots & \vdots \\ H_n & J_n \end{bmatrix},\ x\begin{bmatrix} p_M \\ \frac{1}{M_4} \end{bmatrix},\ b=\begin{bmatrix} -K_1 \\ -K_2 \\ \vdots \\ -K_n \end{bmatrix}. \tag{128}$$

The matrix A and the vector b are both known and a least squares solution technique will be used to obtain a solution for x, called $x_{opt}$, such that the sum of the squares of the elements of the length n residual vector r is minimized where r is defined as $$r=b-Ax_{opt}. \tag{129}$$

The solution is given by $$x_{opt}=(A^TA)^{-1}A^Tb. \tag{130}$$

Equation (130) will be used to solve for the optimal values of $p_M$ and $$\frac{1}{M_4}$$

for multiple data sets.

Referring back to FIG. 1, the excavator 10 typically uses several pieces of equipment to make the appropriate measurements discussed above. In one embodiment of the invention a first sensing device 50 may be coupled with the boom 16. The first sensing device 50 transmits a boom angle signal as a function of the boom angle $\theta_1$ of the excavator 10. The first sensing device 50 may be any of a variety of appropriate devices known to those skilled in the art, such as a rotational position sensor or a cylinder extension sensor.

A second sensing device 52 may be coupled with the stick 18. The second sensing device 52 transmits a stick angle signal as a function of the stick angle $\theta_2$ of the excavator 10.

The second sensing device 52 may also be any of a variety of appropriate devices known to those skilled in the art, such as a rotational position sensor or a cylinder extension sensor.

A third sensing device 54 may be coupled with the bucket 20. The third sensing device 54 transmits a bucket angle signal as a function of the bucket angle $\theta_3$ of the excavator 10. Again, the third sensing device 52 may be any of a variety of appropriate devices known to those skilled in the art, such as a rotational position sensor or a cylinder extension sensor.

A fourth sensing device 56 may be coupled with the hydraulic cylinder 22 that couples the cab 14 with the boom 16. The fourth sensing device 56 transmits a first actuator force signal as a function of a first force exerted on the hydraulic cylinder 22. The first force is typically a net force due to the weights and movements of the boom 16, stick 18, and bucket 20 and its payload, if any, as well as the cab 14 if the excavator 10 is on non-level ground.

In one embodiment of the invention, the fourth sensing device 56 includes two pressure sensors 58, 60 that transmit respective pressure signals as a function of a respective sensed pressure. One of the pressure sensors 58, 60 is coupled with the rod end of the hydraulic cylinder 22 while the other is coupled with the head end. By determining the pressures on each of these sides of the hydraulic cylinder 22, an accurate measure of the net force may be made by ways known to those skilled in the art. In another embodiment of the invention only one sensor may be used, although this will typically result in a less accurate measure of the net force on the cylinder 22.

In one embodiment of the invention, the fourth sensing device 56 may also include a sensor processing circuit 61 that receives the respective pressure signals from the pressure sensors 58, 60 and transmits the first actuator force signal as a.function of the pressure signals. In another embodiment the sensor processing circuit 61 may be included in a processing device 78, discussed below.

A fifth sensing device 62 may be coupled with the hydraulic cylinder 24 that couples the boom 16 and the stick 18. The fifth sensing device 62 transmits a second actuator force signal as a function of a second force exerted on the hydraulic cylinder 24. The second force is typically a net force due to the weights and movements of the stick 18, and bucket 20 and its payload, if any, as well as the cab 14 if the excavator 10 is on non-level ground.

In one embodiment of the invention, the fifth sensing device 62 includes two pressure sensors 64, 66 that transmit respective pressure signals as a function of a respective sensed pressure. One of the pressure sensors 64, 66 is coupled with the rod end of the hydraulic cylinder 24 while the other is coupled with the head end. By determining the pressures on each of these sides of the hydraulic cylinder 24, an accurate measure of the net force may be made by ways known to those skilled in the art. In another embodiment of the invention only one sensor may be used, although this will typically result in a less accurate measure of the net force on the cylinder 24.

In one embodiment of the invention, the fifth sensing device 62 may include a sensor processing circuit 67 that is similar to the sensor processing circuit 61 described above, and which will not be repeated in the interest of brevity.

A sixth sensing device 68 may be coupled with the hydraulic cylinder 26 that couples the stick 18 and the bucket 20. The sixth sensing device 68 transmits a third actuator force signal as a function of a third force exerted on the hydraulic cylinder 26. The third force is typically a net force due to the weights and movements of the bucket 20 and its payload, if any, as well as the cab 14 if the excavator 10 is on non-level ground.

In one embodiment of the invention, the sixth sensing device 68 includes two pressure sensors 70, 72 that transmit respective pressure signals as a function of a respective sensed pressure. One of the pressure sensors 70, 72 is coupled with the rod end of the hydraulic cylinder 26 while the other is coupled with the head end. By determining the pressures on each of these sides of the hydraulic cylinder 26, an accurate measure of the net force may be made by ways known to those skilled in the art. In another embodiment of the invention only one sensor may be used, although this will typically result in a less accurate measure of the net force on the cylinder 26.

In one embodiment of the invention, the sixth sensing device 68 may include a sensor processing circuit 73 that is similar to the sensor processing circuit 61 described above, and which will not be repeated in the interest of brevity.

Although the discussion above uses hydraulic cylinders 22, 24, 26 to actuate the boom 16, stick 18, and bucket 20, other types of actuators known to those skilled in the art could also be used. For example, a variety of motors, such as electric or hydraulic, including pneumatic, motors and couplings for them could be used. Appropriate changes known to those skilled in the art could then typically be made, such as using torque sensors in lieu of pressure sensors, for example.

In one embodiment of the invention, a seventh sensing device 74 may be coupled with either the chassis 12 or the cab 14. The seventh sensing device 74 transmits an inclination angle signal as a function of the inclination angle $\xi$ of the excavator.

In one embodiment of the invention, an eighth sensing device 76 may be coupled with the cab 14. The eighth sensing device transmits a yaw angle signal as a function of a yaw angle of the excavator, e.g., the position of the cab 14 relative to the chassis 12.

A processing device 78 is coupled with the sensing devices 50, 52, 54, 56, 62, 68, 74, 76 to receive their respective signals. The processing device receives the signals from the first-sixth sensing devices 50, 52, 54, 56, 62, 68 at at least two instances in time, and determines the mass or weight of the bucket 20 and any payload in it as a function of the received signals and the predetermined physical characteristics of the excavator 10 using the method described above.

In one embodiment of the invention, the processing device 78 determines the mass of the payload alone, such as by subtracting a known mass/weight of the bucket (unloaded) from the determined mass/weight of the bucket and payload. The processing device may also determine the weight of the payload, such as by multiplying the mass by the acceleration of gravity.

In one embodiment of the invention, the inclination angle and/or the yaw angle may not be needed, and the portions of the invention relating to them may be omitted or ignored. For example, if the excavator 10 is on substantially level ground, the inclination angle may be ignored. It is also possible to have a work machine that is articulated in a way so as to not have a yaw angle. Obviously, in this instance the yaw angle portion may be ignored.

In another embodiment of the invention, a work machine having fewer degrees of freedom, such as a wheel loader, may use the above technique to determine the mass/weight of a payload in a bucket. Similarly, an excavator 10 that has one or more linkage arms that have a relative velocity of zero compared to the other linkages arms may also use the above technique. In these instances, the appropriate variables relating to the stationary or non-existent linkage arm may be nulled out or ignored, and the appropriate sensors providing the data for these terms may be omitted if they are not needed for other terms, e.g., position.

For example, it may be desirable to determine the mass/weight of a bucket 20/payload when the bucket 20 is stationary relative to the stick 18. Thus, any relative velocity and acceleration terms for the bucket 20 may be nulled out or ignored, simplifying the equations. In one embodiment of the invention, the devices, e.g., sensor 54, that provide the relative velocity and acceleration terms for the bucket 20 would still be needed to determine the position of the bucket 20 unless other devices/methods were available to do so.

The above determination of the mass/weight of the bucket 20 and payload may be made while one or all of the boom 16, stick 18, and bucket 20 is in motion, or it may be made while they are motionless, e.g., either static or dynamic cases. In addition, the determination of the mass/weight of the bucket 20 and payload is not dependent on the arm of the excavator being in a predetermined position. Thus, the excavator 10 may be operated normally, e.g., digging and dumping along its normal path, while the determination of the mass/weight of the bucket 20 and payload is made.

Further, in one embodiment of the invention, the determination of the mass/weight of the bucket 20 and payload is analytical, e.g., non-empirical. There is no need to run a calibration of the excavator 10, such as measuring the forces and angles using a known load, and then curve fitting with the unknown load.

In addition, the above method essentially uses torques to determine the mass/weight of the bucket 20 and payload. Thus, if the coupling points for the actuators were different/changed, a slight modification of the basic torque equations could be made without changing other sections of the equations discussed above.

Lastly in one embodiment of the invention, the bucket/load mass may be calculated without knowledge of any of the inertia properties of the bucket and load.

Figure 7:
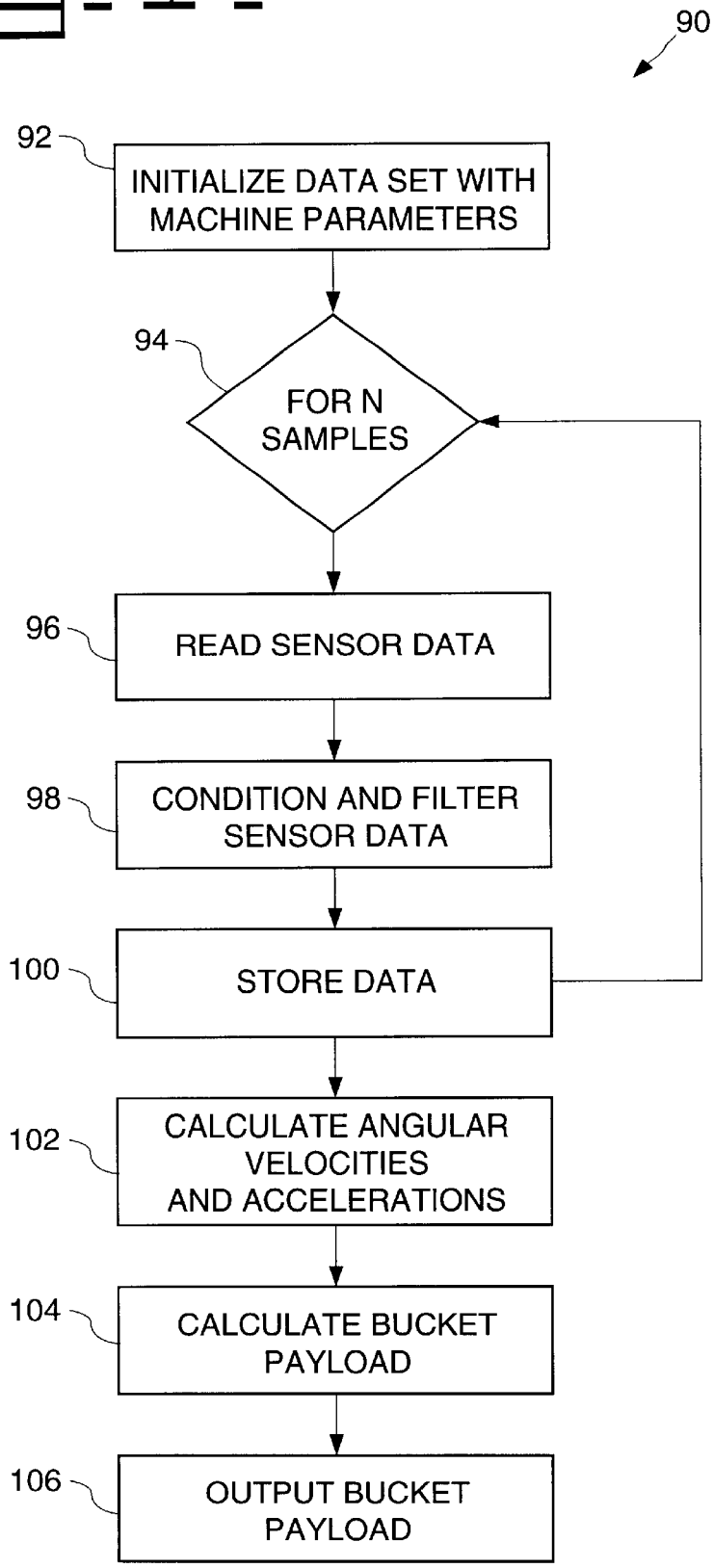
FIG. 7 is a flowchart of an algorithm for determining the mass of the bucket and payload of an excavator according to one embodiment of the invention.

FIG. 7 is a flowchart of an algorithm 90 for determining the mass of the bucket 20 and payload of the excavator 10 according to one embodiment of the invention. In block 92 the predetermined physical characteristics of the excavator 10 are determined, such as by accessing a data-set in a memory.

Block 94 in the algorithm is essentially a counter/pointer that ensures an appropriate number of data samples (greater than one) is taken. In block 96 a sample of the data, e.g., the positions and forces described above acting on the excavator arm, is taken.

In block 98 the data is conditioned and/or filtered into an appropriate state by ways known to those skilled in the art. This block may be omitted, as appropriate.

In block 100 the data is stored. If more data samples are needed or desired, control may jump to block 94 or 96.

In block 102 the angular velocities and accelerations of the cab 14, boom 16, stick 18, and bucket 20, as appropriate, are determined as a function of the positions sampled above.

In block 104 the mass/weight of the bucket payload is determined, as described above.

In block 106 the mass/weight of the bucket payload is output, such as to a visual display (not shown) or to a summer (not shown) that keeps track of the total mass/weight of the bucket payloads over a predetermined period of time.

Although one flowchart of the algorithm 90 is discussed above, a variety of equivalent flowcharts could also be used. For example, block 94 could be moved to follow block 100, with block 100 always passing control to block 94. In block 94, if n samples had been taken, control would pass to block 102. If not, control would jump to block 96.

Industrial Applicability

The invention may be used by an operator of an excavator 10 to determine the weight of the payload of the bucket 20. The operator loads the bucket 20 using a normal dig pass. As the bucket is swung towards its unloading point, such as above a truck, the weight of the payload is determined, and may be visually displayed. The operator need not stop the motion of the excavator arm, nor cause it to enter a predetermined configuration/position.

From the foregoing it will be appreciated that, although specific embodiments of the invention have been described herein for purposes of illustration, various modifications may be made without deviating from the spirit or scope of the invention. Accordingly, the invention is not limited except as by the appended claims.

What is claimed is:

1. An apparatus for determining a mass of a payload in a work machine, the work machine having a chassis, a cab coupled with the chassis, a boom coupled with the cab, a first actuator coupled with the boom and the cab and operable to move the boom relative to the cab, a stick coupled with the boom, a second actuator coupled with the stick and the boom and operable to move the stick relative to the boom, a bucket operable to receive the payload, the bucket coupled with the stick, and a third actuator coupled with the bucket and the stick and operable to move the bucket relative to the stick, the apparatus comprising:

a first sensing device coupled with the boom and operable to transmit a boom angle signal as a function of a boom angle of the work machine;

a second sensing device coupled with the stick and operable to transmit a stick angle signal as a function of a stick angle of the work machine;

a third sensing device coupled with the bucket and operable to transmit a bucket angle signal as a function of a bucket angle of the work machine;

a fourth sensing device coupled with the first actuator and operable to transmit a first actuator force signal as a function a first force exerted on the first actuator;

a fifth sensing device coupled with the second actuator and operable to transmit a second actuator force signal as a function a second force exerted on the second actuator;

a sixth sensing device coupled with the third actuator and operable to transmit a third actuator force signal as a function a third force exerted on the third actuator; and a processing device coupled with the first through sixth sensing devices to receive the respective transmitted signals at at least two instances in time, the processing device operable to determine a mass of the bucket and payload as a function of the received signals and a plurality of predetermined physical characteristics of the work machine.

2. The apparatus of claim 1 wherein the processing device is operable to analytically determine the mass of the bucket and payload.

3. The apparatus of claim 1 wherein the processing device is operable to non-empirically determine the mass of the bucket and payload.

4. The apparatus of claim 1 wherein the processor is operable to determine the mass of the bucket and payload while at least one of the boom, the stick, and the bucket is in motion.

5. The apparatus of claim 1 wherein the processing device is operable to determine the mass of the bucket and payload using a least squares approach.

6. The apparatus of claim 1 wherein the plurality of predetermined characteristics comprises a plurality of:

a mass of the cab;

a mass of the boom;

a mass of the stick;

a mass of the bucket;

a location of center of mass of the cab;

a location of center of mass of the boom;

a location of center of mass of the stick;

a location of center of mass of the bucket;

a moment of inertia of the cab;

a moment of inertia of the boom;

a moment of inertia of the stick;

a moment of inertia of the bucket; and a plurality of geometries of the work machine.

7. The apparatus of claim 1 wherein the processing device is operable to determine the mass of the bucket and payload ($M_4$) as a function of:

$$A = \begin{bmatrix} H_1 & J_1 \\ H_2 & J_2 \\ \vdots & \vdots \\ H_n & J_n \end{bmatrix}, x = \begin{bmatrix} p_M \\ \frac{1}{M_4} \end{bmatrix}, b = \begin{bmatrix} -K_1 \\ -K_2 \\ \vdots \\ -K_n \end{bmatrix}$$

$$x_{opt} = (A^T A)^{-1} A^T b$$

wherein n is the number of instances in time that the processing device receives the respective transmitted signals.

8. The apparatus of claim 1 wherein the processing device is further operable to determine the mass of the payload as a function of the predetermined physical characteristics of the work machine.

9. The apparatus of claim 1 wherein each of the first, second, and third actuators comprise hydraulic cylinders, and each of the fourth, fifth, and sixth sensing devices comprises:

a respective first pressure sensor operable to transmit a respective first pressure signal as a function of a respective first pressure at a first location in the respective first, second, and third cylinders, the first location being at one of a head end and a rod end of the cylinder;

a respective second pressure sensor operable to transmit a respective second pressure signal as a function of a respective second pressure at a second location in the respective first, second, and third cylinders, the second location being at the other of the head end and the rod end of the cylinder; and a respective sensor processing circuit coupled with the respective first and second pressure sensors to receive the respective first and second pressure signals, the respective sensor processing circuit operable to transmit the respective first, second, and third actuator force signals as a function of the respective first and second pressure signals.

10. The apparatus of claim 1 wherein the first, second, and third forces acting on the respective first, second, and third actuators respectively comprise a first, second, and third net force.

11. The apparatus of claim 1 wherein the first, second, and third actuators comprise at least one of:

a hydraulic cylinder; and a motor.

12. The apparatus of claim 1, further comprising:

a seventh sensing device operable to transmit an inclination angle signal as a function of an inclination angle of the work machine, the processing device operable to receive the inclination angle signal and to determine the mass of the bucket and payload as a further function of the inclination angle signal.

13. The apparatus of claim 1 wherein the cab of the work machine is operable to rotate about the chassis, and further comprising:

an eighth sensing device operable to transmit a yaw angle signal as a function of a yaw angle of the work machine, the processing device coupled with the eighth sensing device to receive the yaw angle signal at at least two instances in time and being further operable to determine the mass of the bucket and payload as a function of the yaw angle signals.

14. The apparatus of claim 13 wherein the processor is further operable to determine the mass of the bucket and payload while the cab is in motion relative to the chassis.

15. A method for determining a mass of a payload in a work machine, the work machine having a chassis, a cab coupled with the chassis, a boom coupled with the cab, a first actuator coupled with the boom and the cab and operable to move the boom relative to the cab, a stick coupled with the boom, a second actuator coupled with the stick and the boom and operable to move the stick relative to the boom, a bucket operable to receive the payload, the bucket coupled with the stick, and a third actuator coupled with the bucket and the stick and operable to move the bucket relative to the stick, the method comprising:

determining a first joint angle of the boom relative to the cab at at least two instances in time;

determining a second joint angle of the stick relative to the boom at at least two instances in time;

determining a third joint angle of the bucket relative to the stick at at least two instances in time;

determining a first actuator force exerted on the first actuator at at least two instances in time;

determining a second actuator force exerted on the second actuator at at least two instances in time;

determining a third actuator force exerted on the third actuator at at least two instances in time;

determining a plurality of physical characteristics of the work machine; and determining a one of a mass of the bucket and payload as a function of the first joint angles, the second joint angles, the third joint angles, the first actuator forces, the second actuator forces, the third actuator forces, and the plurality of predetermined physical characteristics.

16. The method of claim 15 wherein determining the mass of the bucket and payload comprises analytically determining the mass of the payload.

17. The method of claim 15 wherein determining the mass of the bucket and payload comprises non-empirically determining the mass of the payload.

18. The method of claim 15 wherein determining the mass of the bucket and payload occurs while at least one of the boom, stick, and bucket is in motion.

19. The method of claim 15 wherein determining the mass of the bucket and payload comprises determining the mass of the payload using a least squares approach.

20. The method of claim 15 wherein the plurality of predetermined physical characteristics comprises a plurality of:

a mass of the cab;

a mass of the boom;

a mass of the stick;

a mass of the bucket;

a location of center of mass of the cab;

a location of center of mass of the boom;

a location of center of mass of the stick;

a location of center of mass of the bucket;

a moment of inertia of the cab;

a moment of inertia of the boom;

a moment of inertia of the stick;

a moment of inertia of the bucket; and a plurality of geometries of the work machine.

21. The method of claim 15 wherein determining the mass of the bucket and payload ($M_4$) comprises solving the following equation for $M_4$:

$$A=\begin{bmatrix} H_1 & J_1 \\ H_2 & J_2 \\ \vdots & \vdots \\ H_n & J_n \end{bmatrix}, x=\begin{bmatrix} p_M \\ \frac{1}{M_4} \end{bmatrix}, b=\begin{bmatrix} -K_1 \\ -K_2 \\ \vdots \\ -K_n \end{bmatrix}$$

$$x_{opt}=(A^TA)^{-1}A^Tb$$

wherein n is the number of instances in time that the first, second, and third joint angles and first, second, and third actuator forces are determined.

22. The method of claim 15, further comprising determining the mass of the payload as a function of the predetermined physical characteristics of the work machine.

23. The method of claim 15 wherein each of the first, second, and third actuators comprise hydraulic cylinders, and determining the first, second, and third forces exerted on the actuator comprises:

determining a respective first pressure as a function of a respective first pressure at a first location in the respective first, second, and third cylinders, the first location being at one of a head end and a rod end of the cylinder;

determining a respective second pressure as a function of a respective second pressure at a second location in the respective first, second, and third cylinders, the second location being at the other of the head end and the rod end of the cylinder; and determining a respective first, second, and third actuator forces as a function of the respective first and second pressures.

24. The method of claim 15 wherein the first, second, and third forces acting on the respective first, second, and third actuators respectively comprise a first, second, and third net force.

25. The apparatus of claim 15, further comprising:

determining an inclination angle of the work machine, and wherein determining the mass of the bucket and payload is further a function of the inclination angle.

26. The method of claim 15 wherein the cab of the work machine is operable to rotate about the chassis, and further comprising:

determining a yaw angle of the work machine at at least two instances in time and wherein determining the mass of the bucket and payload is further a function of the yaw angle.

27. The method of claim 26 wherein determining the mass of the payload comprises determining the mass of the bucket and payload while the cab is in motion relative to the chassis.

28. An apparatus for determining a mass of a payload in a work machine, the work machine having a chassis, a cab coupled with the chassis, a boom coupled with the cab, a first actuator coupled with the boom and the cab and operable to move the boom relative to the cab, a stick coupled with the boom, a second actuator coupled with the stick and the boom and operable to move the stick relative to the boom, a bucket operable to receive the payload, the bucket coupled with the stick, and a third actuator coupled with the bucket and the stick and operable to move the bucket relative to the stick, the apparatus comprising:

a first sensing device coupled with the boom and operable to transmit a boom angle signal as a function of a boom angle of the work machine;

a second sensing device coupled with the stick and operable to transmit a stick angle signal as a function of a stick angle of the work machine;

a third sensing device coupled with the bucket and operable to transmit a bucket angle signal as a function of a bucket angle of the work machine;

a fourth sensing device coupled with the first actuator and operable to transmit a first actuator force signal as a function a first force exerted on the first actuator;

a fifth sensing device coupled with the second actuator and operable to transmit a second actuator force signal as a function a second force exerted on the second actuator;

a sixth sensing device coupled with the third actuator and operable to transmit a third actuator force signal as a function a third force exerted on the third actuator; and a processing device coupled with the first, second, and fourth through sixth sensing devices to receive the respective transmitted signals at at least two instances in time, and coupled with the third sensing device to receive the bucket angle signal at at least one instance in time, the processing device operable to determine a mass of the bucket and payload as a function of the received signals and a plurality of predetermined physical characteristics of the work machine while the bucket is relatively immobile with respect to the stick.

29. The apparatus of claim 28 wherein the processing device is operable to analytically determine the mass of the bucket and payload.

30. The apparatus of claim 28 wherein the processing device is operable to non-empirically determine the mass of the bucket and payload.

31. The apparatus of claim 28 wherein the processor is operable to determine the mass of the bucket and payload while at least one of the boom and the stick is in motion.

32. The apparatus of claim 28 wherein the processing device is operable to determine the mass of the bucket and payload using a least squares approach.

33. The apparatus of claim 28 wherein the plurality of predetermined characteristics comprises a plurality of:

a mass of the cab;

a mass of the boom;

a mass of the stick;

a mass of the bucket;

a location of center of mass of the cab;

a location of center of mass of the boom;

a location of center of mass of the stick;

a location of center of mass of the bucket;

a moment of inertia of the cab;

a moment of inertia of the boom;

a moment of inertia of the stick;

a moment of inertia of the bucket; and a plurality of geometries of the work machine.

34. The apparatus of claim 28 wherein the processing device is operable to determine the mass of the bucket and payload ($M_4$) as a function of;

$$A = \begin{bmatrix} H_1 & J_1 \\ H_2 & J_2 \\ \vdots & \vdots \\ H_n & J_n \end{bmatrix}, x = \begin{bmatrix} p_M \\ \frac{1}{M_4} \end{bmatrix}, b = \begin{bmatrix} -K_1 \\ -K_2 \\ \vdots \\ -K_n \end{bmatrix}$$

$$x_{opt} = (A^T A)^{-1} A^T b$$

wherein n is the number of instances in time that the processing device receives the respective transmitted signals from the first, second, and fourth through sixth sensing devices, and the terms corresponding to motion of the bucket relative to the stick are nulled out.

35. The apparatus of claim 28 wherein the processing device is further operable to determine the mass of the payload as a function of the predetermined physical characteristics of the work machine.

36. The apparatus of claim 28 wherein each of the first, second, and third actuators comprise hydraulic cylinders, and each of the fourth, fifth, and sixth sensing devices comprises:

a respective first pressure sensor operable to transmit a respective first pressure signal as a function of a respective first pressure at a first location in the respective first, second, and third cylinders, the first location being at one of a head end and a rod end of the cylinder;

a respective second pressure sensor operable to transmit a respective second pressure signal as a function of a respective second pressure at a second location in the respective first, second, and third cylinders, the second location being at the other of the head end and the rod end of the cylinder; and a respective sensor processing circuit coupled with the respective first and second pressure sensors to receive the respective first and second pressure signals, the respective sensor processing circuit operable to transmit the respective first, second, and third actuator force signals as a function of the respective first and second pressure signals.

37. The apparatus of claim 28 wherein the first, second, and third forces acting on the respective first, second, and third actuators respectively comprise a first, second, and third net force.

38. The apparatus of claim 28 wherein the first, second, and third actuators comprise at least one of:

a hydraulic cylinder; and a motor.

39. The apparatus of claim 28, further comprising:

a seventh sensing device operable to transmit an inclination angle signal as a function of an inclination angle of the work machine, the processing device operable to receive the inclination angle signal and to determine the mass of the bucket and payload as a further function of the inclination angle signal.

40. The apparatus of claim 28 wherein the cab of the work machine is operable to rotate about the chassis, and further comprising:

an eighth sensing device operable to transmit a yaw angle signal as a function of a yaw angle of the work machine, the processing device coupled with the eighth sensing device to receive the yaw angle signal at at least two instances in time and being further operable to determine the mass of the bucket and payload as a function of the yaw angle signals.

41. The apparatus of claim 40 wherein the processor is further operable to determine the mass of the bucket and payload while the cab is in motion relative to the chassis.

42. A method for determining a mass of a payload in a work machine, the work machine having a chassis, a cab coupled with the chassis, a boom coupled with the cab, a first actuator coupled with the boom and the cab and operable to move the boom relative to the cab, a stick coupled with the boom, a second actuator coupled with the stick and the boom and operable to move the stick relative to the boom, a bucket operable to receive the payload, the bucket coupled with the stick, and a third actuator coupled with the bucket and the stick and operable to move the bucket relative to the stick, the method comprising:

determining a first joint angle of the boom relative to the cab at at least two instances in time;

determining a second joint angle of the stick relative to the boom at at least two instances in time;

determining a third joint angle of the bucket relative to the stick at at least one instance in time;

determining a first actuator force exerted on the first actuator at at least two instances in time;

determining a second actuator force exerted on the second actuator at at least two instances in time;

determining a third actuator force exerted on the third actuator at at least two instances in time;

determining a plurality of physical characteristics of the work machine; and determining a one of a mass of the bucket and payload as a function of the first joint angles, the second joint angles, the third joint angles, the first actuator forces, the second actuator forces, the third actuator forces, and the plurality of predetermined physical characteristics while the bucket is relatively immobile with respect to the stick.

43. The method of claim 42 wherein determining the mass of the bucket and payload comprises analytically determining the mass of the payload.

44. The method of claim 42 wherein determining the mass of the bucket and payload comprises non-empirically determining the mass of the payload.

45. The method of claim 42 wherein determining the mass of the bucket and payload occurs while at least one of the boom and the stick is in motion.

46. The method of claim 42 wherein determining the mass of the bucket and payload comprises determining the mass of the payload using a least squares approach.

47. The method of claim 42 wherein the plurality of predetermined physical characteristics comprises a plurality of:

a mass of the cab;

a mass of the boom, a mass of the stick;

a mass of the bucket;

a location of center of mass of the cab;

a location of center of mass of the boom;

a location of center of mass of the stick;

a location of center of mass of the bucket;

a moment of inertia of the cab;

a moment of inertia of the boom;

a moment of inertia of the stick;

a moment of inertia of the bucket; and a plurality of geometries of the work machine.

48. The method of claim 42 wherein determining the mass of the bucket and payload ($M_4$) comprises solving the following equation for $M_4$:

$$A = \begin{bmatrix} H_1 & J_1 \\ H_2 & J_2 \\ \vdots & \vdots \\ H_n & J_n \end{bmatrix}, x = \begin{bmatrix} p_M \\ \frac{1}{M_4} \end{bmatrix}, b = \begin{bmatrix} -K_1 \\ -K_2 \\ \vdots \\ -K_n \end{bmatrix}$$

$$x_{opt} = (A^T A)^{-1} A^T b$$

wherein n is the number of instances in time that the first and second joint angles and first, second, and third actuator forces are determined and the terms corresponding to motion of the bucket relative to the stick are nulled out.

49. The method of claim 42, further comprising determining the mass of the payload as a function of the predetermined physical characteristics of the work machine.

50. The method of claim 42 wherein each of the first, second, and third actuators comprise hydraulic cylinders, and determining the first, second, and third forces exerted on the actuator comprises:

determining a respective first pressure as a function of a respective first pressure at a first location in the respective first, second, and third cylinders, the first location being at one of a head end and a rod end of the cylinder;

determining a respective second pressure as a function of a respective second pressure at a second location in the respective first, second, and third cylinders, the second location being at the other of the head end and the rod end of the cylinder; and determining a respective first, second, and third actuator forces as a function of the respective first and second pressures.

51. The method of claim 42 wherein the first, second, and third forces acting on the respective first, second, and third actuators respectively comprise a first, second, and third net force.

52. The apparatus of claim 42, further comprising:

determining an inclination angle of the work machine, and wherein determining the mass of the bucket and payload is further a function of the inclination angle.

53. The method of claim 42 wherein the cab of the work machine is operable to rotate about the chassis, and further comprising:

determining a yaw angle of the work machine at at least two instances in time and wherein determining the mass of the bucket and payload is further a function of the yaw angle.

54. The method of claim 53 wherein determining the mass of the payload comprises determining the mass of the bucket and payload while the cab is in motion relative to the chassis.

* * * * *